US011535969B2

(12) United States Patent
Angelini et al.

(10) Patent No.: US 11,535,969 B2
(45) Date of Patent: Dec. 27, 2022

(54) FLUID DELIVERY SYSTEM FOR A FRONT-LOAD WASHING APPLIANCE FOR DELIVERING FLUID TO LIFTERS OF THE DRUM

(71) Applicant: WHIRLPOOL CORPORATION, Benton Harbor, MI (US)

(72) Inventors: Marco Angelini, Folignano (IT); Matteo Carnevale, Esanatoglia (IT); Massimiliano Daniele, Milan (IT); Deepak Gupta, Varese (IT); Mauro Mancini, Fabriano (IT); Vaclav Petracek, Poprad (SK)

(73) Assignee: Whirlpool Corporation, Benton Harbor, MI (US)

( * ) Notice: Subject to any disclaimer, the term of this patent is extended or adjusted under 35 U.S.C. 154(b) by 210 days.

(21) Appl. No.: 16/868,451

(22) Filed: May 6, 2020

(65) Prior Publication Data

US 2020/0378050 A1 Dec. 3, 2020

Related U.S. Application Data

(60) Provisional application No. 62/853,819, filed on May 29, 2019.

(51) Int. Cl.

| | |
|---|---|
| ***D06F 37/00*** | (2020.01) |
| ***D06F 37/06*** | (2006.01) |
| ***D06F 23/02*** | (2006.01) |
| ***D06F 37/30*** | (2020.01) |
| ***D06F 39/08*** | (2006.01) |

(52) U.S. Cl.
CPC ..... *D06F 37/065* (2013.01); *D06F 23/02* (2013.01); *D06F 37/30* (2013.01); *D06F 39/088* (2013.01)

(58) Field of Classification Search
None
See application file for complete search history.

(56) References Cited

U.S. PATENT DOCUMENTS

| | | | | |
|---|---|---|---|---|
| 4,580,421 | A * | 4/1986 | Babuin | D06F 39/083 68/16 |
| 6,981,395 | B2 | 1/2006 | Ryu et al. | |
| 8,991,219 | B2 | 3/2015 | Hasanreisoglu | |
| 2006/0081018 | A1 | 4/2006 | Kim | |
| 2007/0017261 | A1* | 1/2007 | Chang | D06F 37/22 68/23.1 |
| 2011/0005277 | A1* | 1/2011 | Hasanreisoglu | D06F 37/065 68/12.06 |
| 2012/0144879 | A1 | 6/2012 | Verma | |

(Continued)

FOREIGN PATENT DOCUMENTS

| | | |
|---|---|---|
| CN | 1207427 | 2/1999 |
| CN | 104321480 | 1/2015 |

(Continued)

*Primary Examiner* — Cristi J Tate-Sims
(74) *Attorney, Agent, or Firm* — Price Heneveld LLP

(57) ABSTRACT

A front-load laundry appliance includes a drum that is rotationally operable within a tub about a generally horizontal rotational axis. A plurality of lifters are coupled to an interior surface of the drum. A fluid delivery path is at least partially defined within the drum and the plurality of lifters. A fluid delivery system delivers fluid into the fluid delivery path in a direction parallel to the generally horizontal rotational axis.

20 Claims, 37 Drawing Sheets

(56) References Cited

U.S. PATENT DOCUMENTS

| | | | | |
|---|---|---|---|---|
| 2013/0036774 | A1 | 2/2013 | Kim et al. | |
| 2013/0081432 | A1* | 4/2013 | Choi | D06F 37/06 68/142 |
| 2013/0091902 | A1* | 4/2013 | Hill | H02K 5/04 310/43 |
| 2015/0167227 | A1 | 6/2015 | Kim et al. | |
| 2017/0096762 | A1* | 4/2017 | Jo | D06F 37/225 |

FOREIGN PATENT DOCUMENTS

| | | |
|---|---|---|
| CN | 107245842 | 10/2017 |
| DE | 3934434 | 4/1991 |
| DE | 4140094 | 6/1993 |
| DE | 4410337 | 8/1995 |
| EP | 2463432 | 6/2012 |
| EP | 3575475 | 12/2019 |
| KR | 101771853 | 9/2017 |
| WO | 2008065690 | 6/2008 |
| WO | 2009083352 | 7/2009 |

* cited by examiner

FLUID DELIVERY SYSTEM FOR A FRONT-LOAD WASHING APPLIANCE FOR DELIVERING FLUID TO LIFTERS OF THE DRUM

CROSS-REFERENCE TO RELATED APPLICATION

This application claims priority to and the benefit under 35 U.S.C. § 119(e) of U.S. Provisional Patent Application No. 62/853,819, filed on May 29, 2019, entitled FLUID DELIVERY SYSTEM FOR A FRONT-LOAD WASHING APPLIANCE FOR DELIVERING FLUID TO LIFTERS OF THE DRUM, the entire disclosure of which is hereby incorporated herein by reference.

FIELD OF THE DEVICE

The device is in the field of laundry appliances, and more specifically, a fluid delivery system for a front-load laundry appliance, where fluid is delivered to lifters of the drum via a fluid delivery path that is generally parallel to a rotational axis of the drum.

BRIEF SUMMARY OF THE DEVICE

According to one aspect of the present disclosure, a front-load laundry appliance includes a drum that is rotationally operable within a tub about a generally horizontal rotational axis. A plurality of lifters are coupled to an interior surface of the drum. A fluid delivery path is at least partially defined within the drum and the plurality of lifters. A fluid delivery system delivers fluid into the fluid delivery path in a direction parallel to the generally horizontal rotational axis.

According to another aspect of the present disclosure, a front-load laundry appliance includes a drum that is rotationally operable within a tub. Lifters are disposed on an interior surface of the drum. Fluid is delivered to the drum via lifters that are attached to a wall of the drum. Fluid is delivered to the lifters through a fluid inlet that extends through the tub and in an axial direction parallel with a drive shaft and a rotational axis of the drum. A drive shaft is attached to the drum. The fluid inlet extends axially through the drive shaft to a manifold that apportions the fluid among the lifters of the drum. The front-load laundry appliance includes a plurality of bearings, wherein the fluid inlet includes a fluid space defined between the drive shaft, a hub of the tub and the plurality of bearings that rotationally couple the drive shaft to the tub.

According to yet another aspect of the present disclosure, a drum is rotationally operable within a tub. Lifters are disposed on an interior surface of the drum. Fluid is delivered to the drum via lifters that are attached to a wall of the drum. Fluid is delivered to the lifters through a fluid inlet that extends through the tub and in an axial direction parallel with a drive shaft and a rotational axis of the drum. The fluid inlet is positioned near an outer circumference of the tub and extends to a perimeter fluid channel of the drum. The lifters extend from the perimeter fluid channel to define an interior space through which the fluid is moved to the lifters. Fluid is delivered to the perimeter fluid channel as the drum is rotated.

These and other features, advantages, and objects of the present disclosure will be further understood and appreciated by those skilled in the art by reference to the following specification, claims, and appended drawings.

Figure 1:
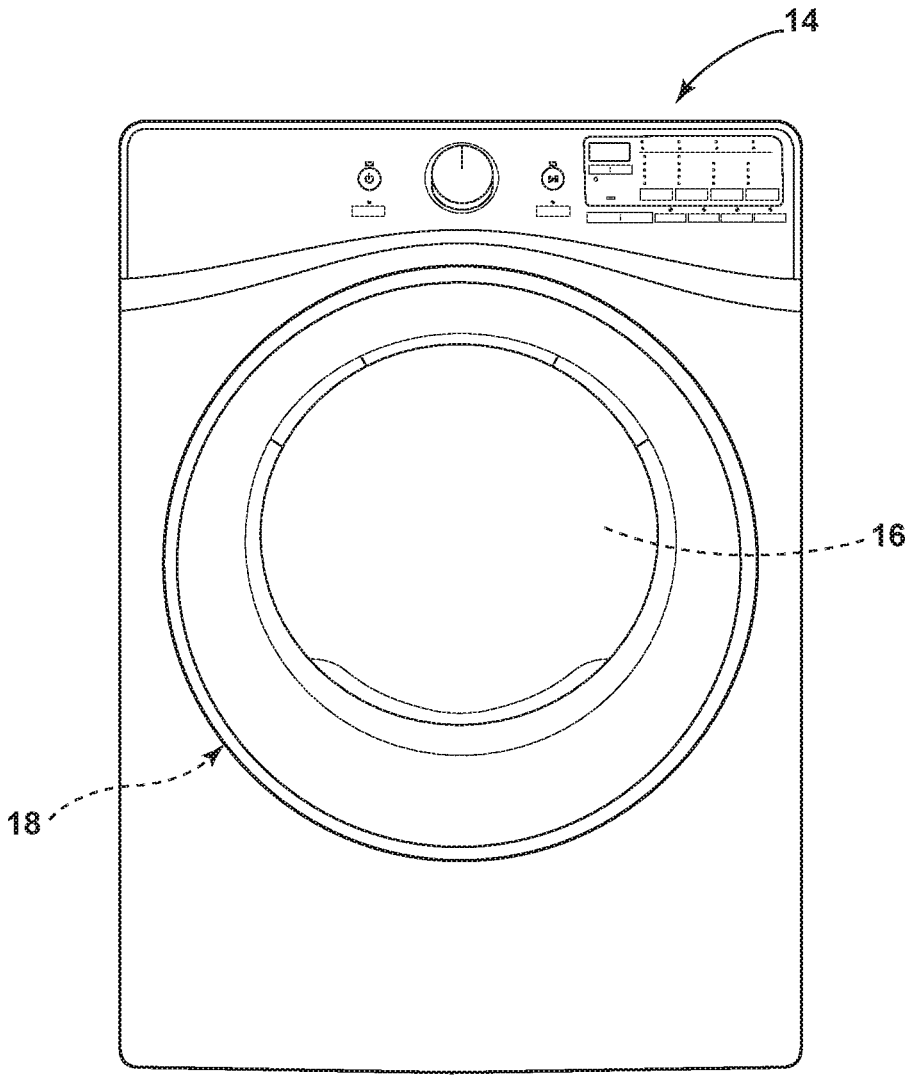
FIG. 1 is a front perspective view of a laundry appliance incorporating an aspect of the fluid delivery path for delivering fluid to lifters of the drum.
Figure 2:
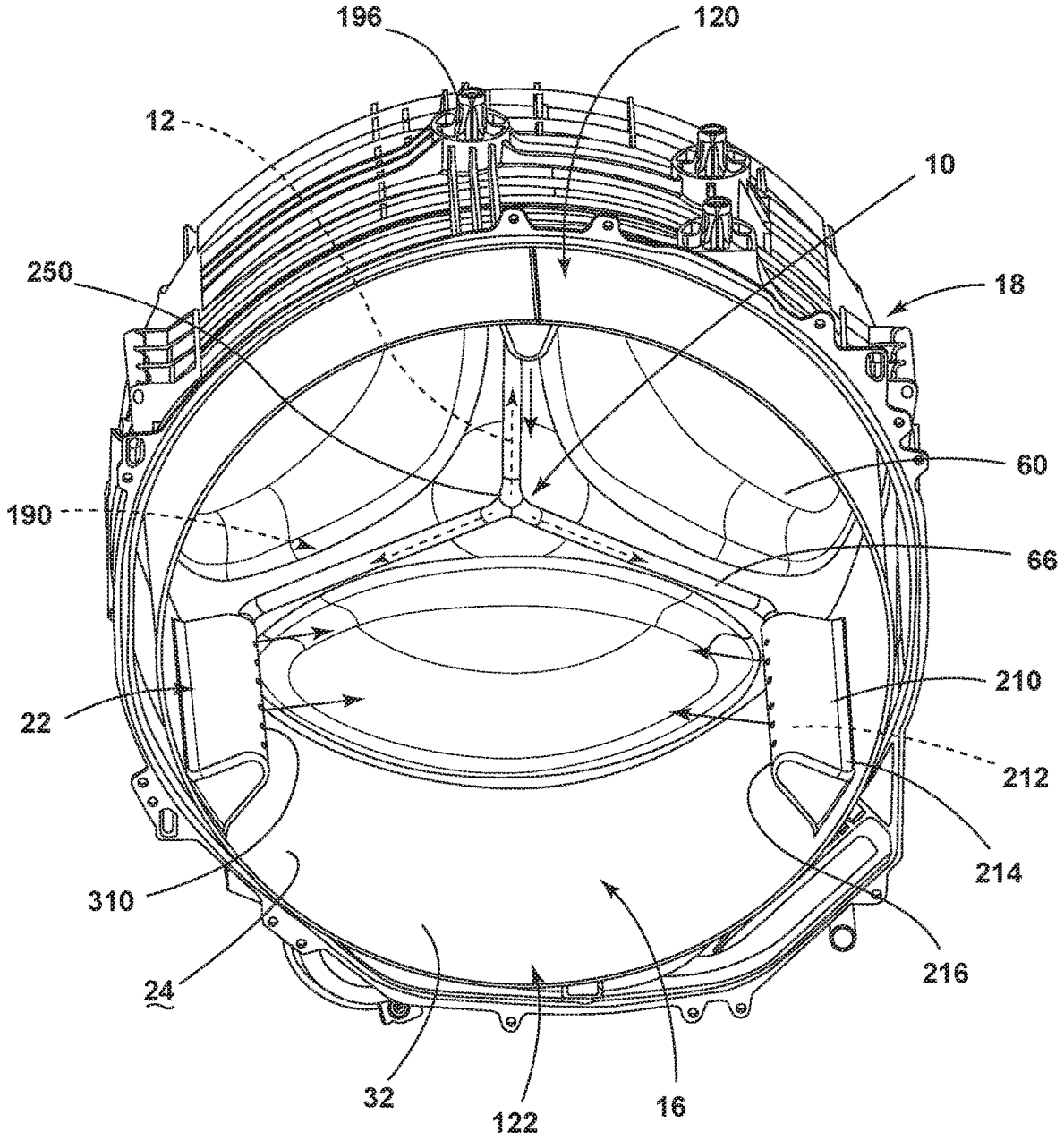
FIG. 2 is a front perspective view of an aspect of the fluid delivery path for delivering fluid to lifters of the drum.
Figure 3:
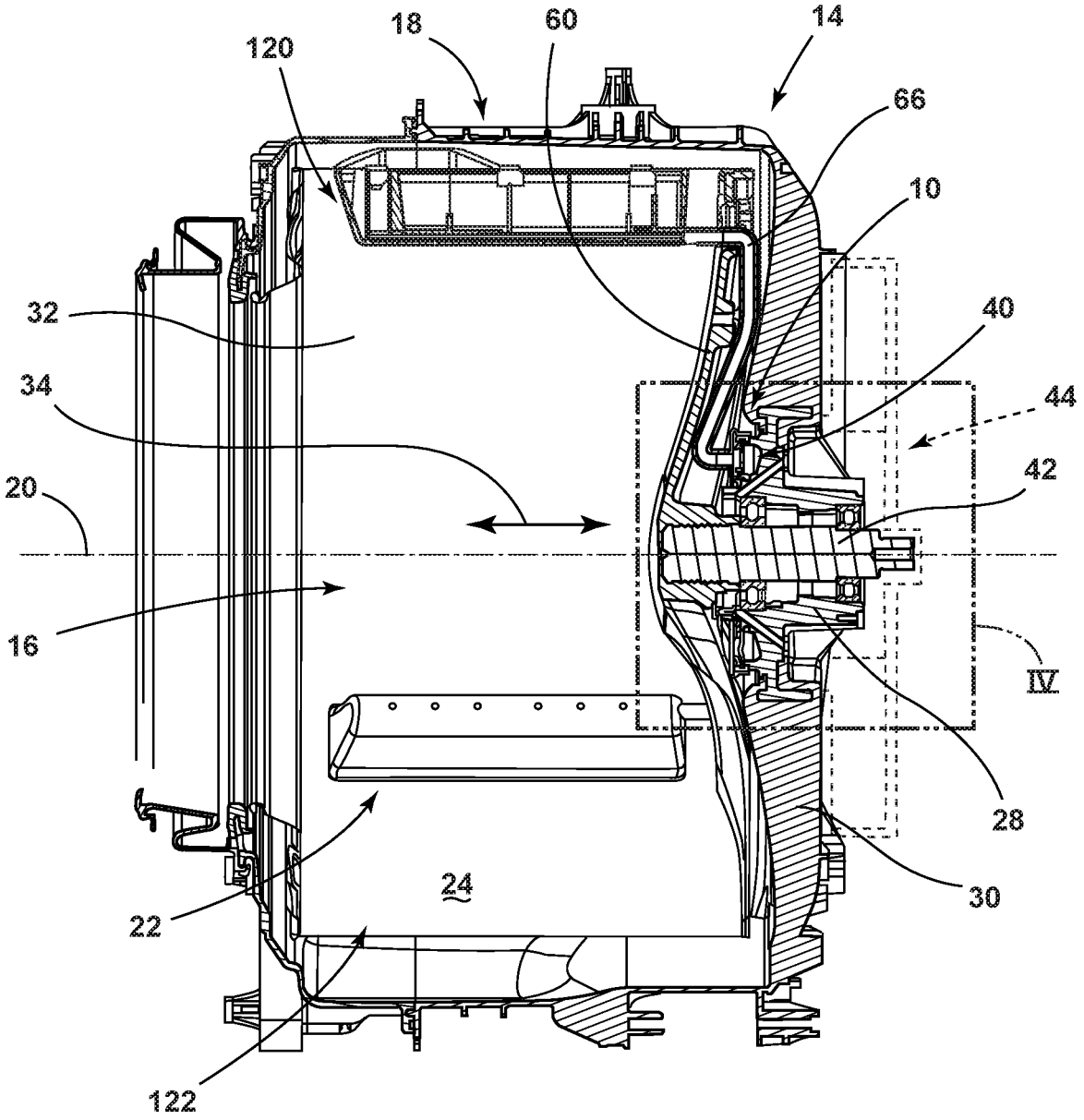
FIG. 3 is a cross-sectional view of an aspect of a laundry appliance incorporating a fluid delivery path for delivering fluid to lifters of the drum.
Figure 4:
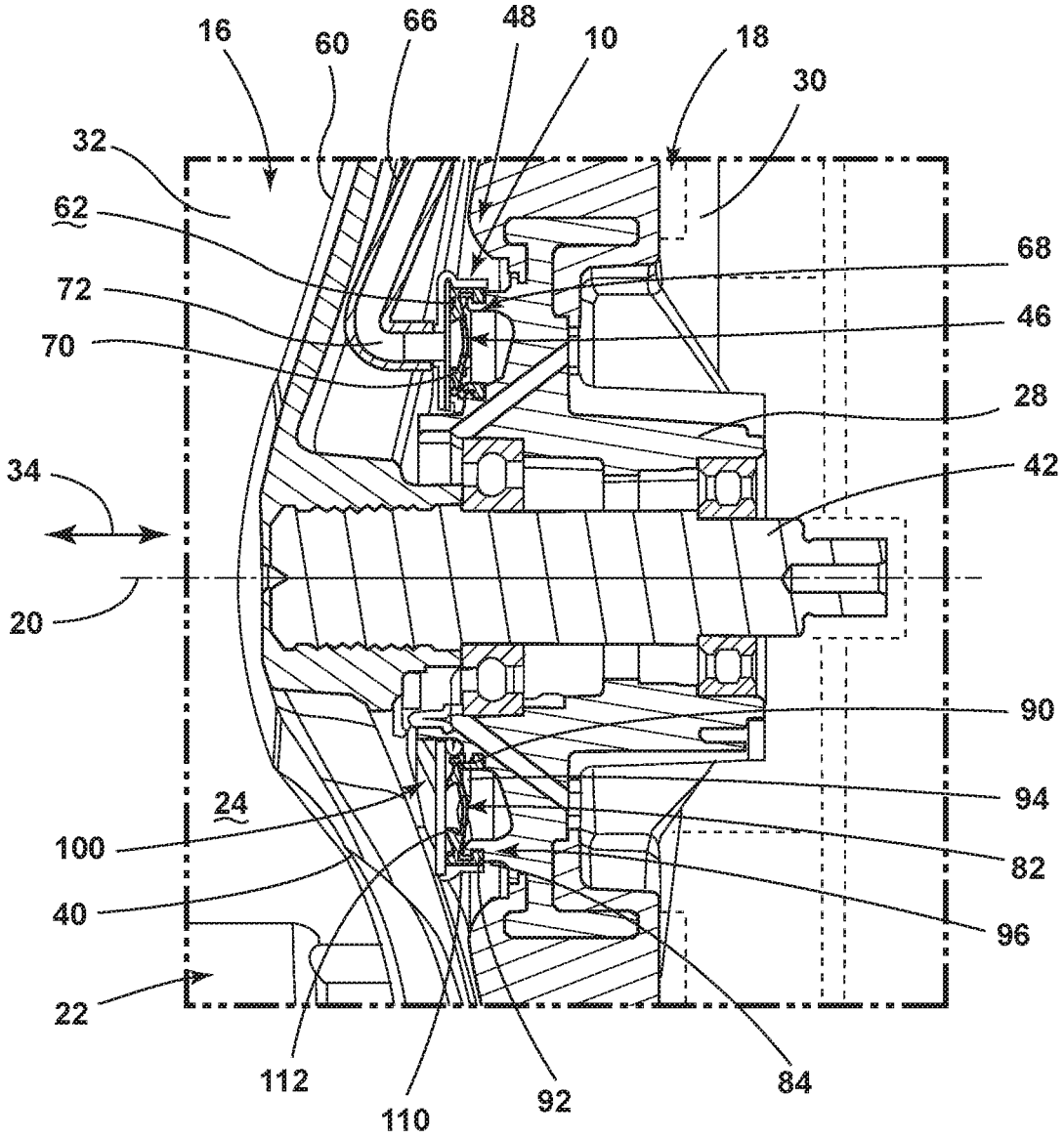
FIG. 4 is an enlarged cross-sectional view of the laundry appliance of FIG. 3 taken at area IV.
Figure 5:
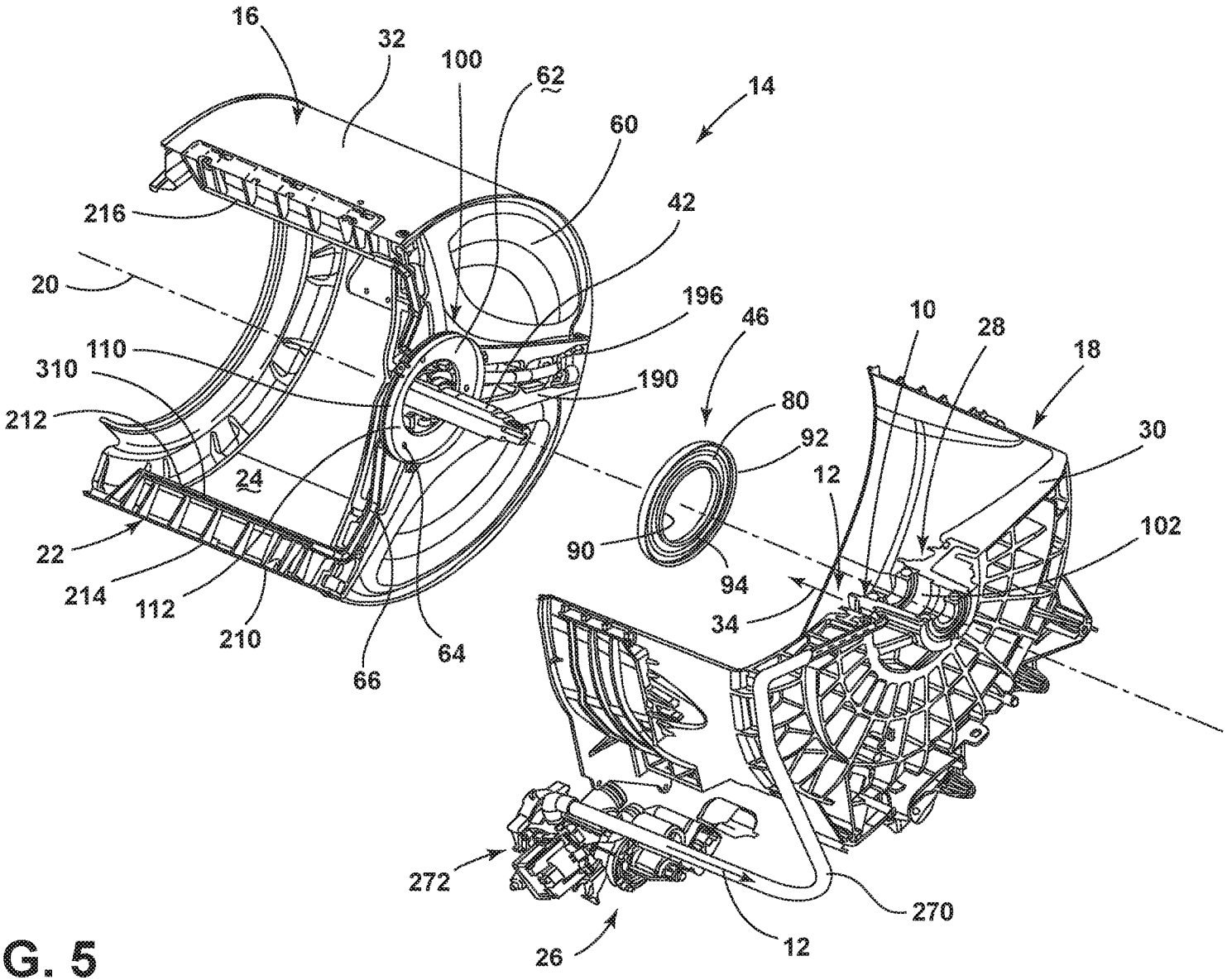
FIG. 5 is an exploded perspective view of the laundry appliance of FIG. 3.
Figure 6:
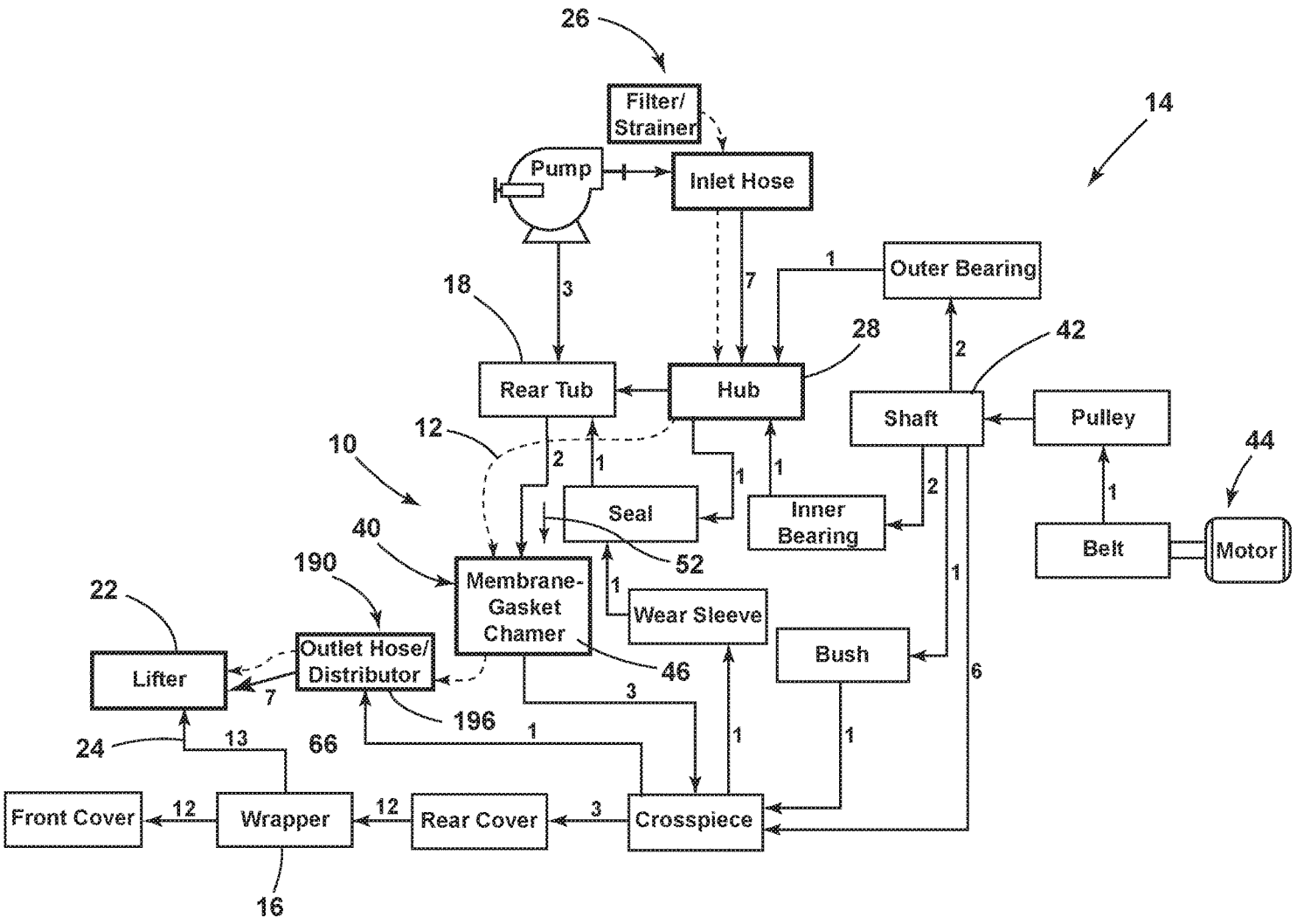
FIG. 6 is a schematic diagram illustrating a fluid flow path that operates in conjunction with the drive system for the laundry appliance.
Figure 7:
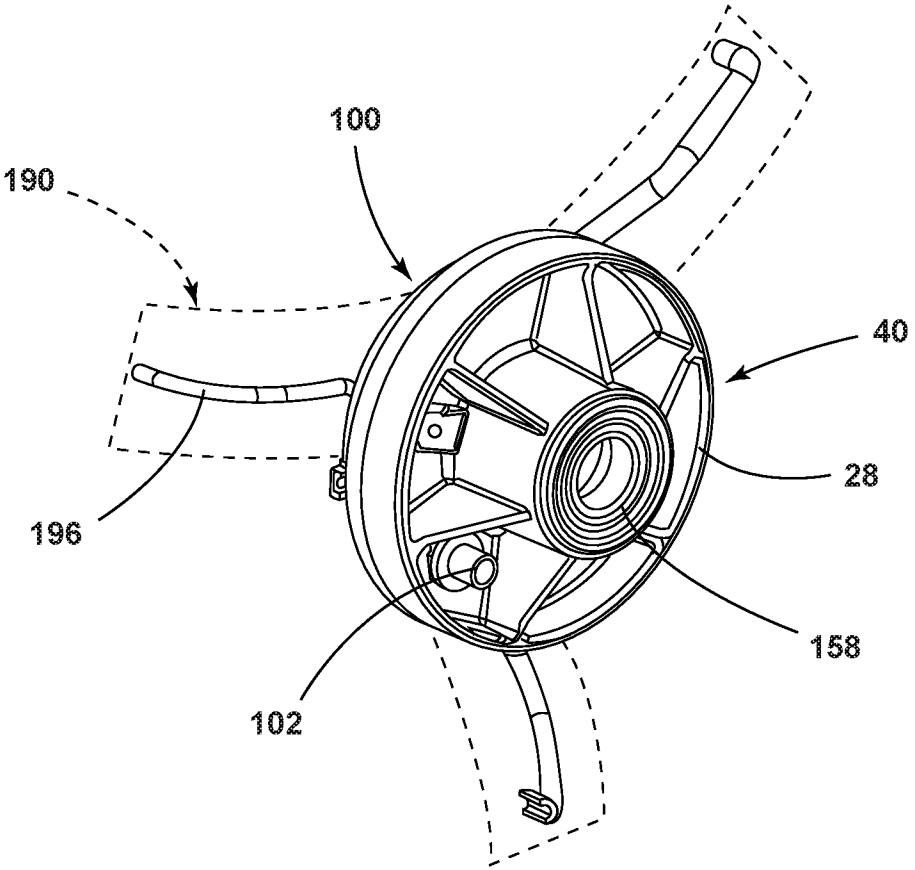
FIG. 7 is a rear perspective view of an aspect of a fluid delivery ring used within a fluid delivery path.
Figure 8:
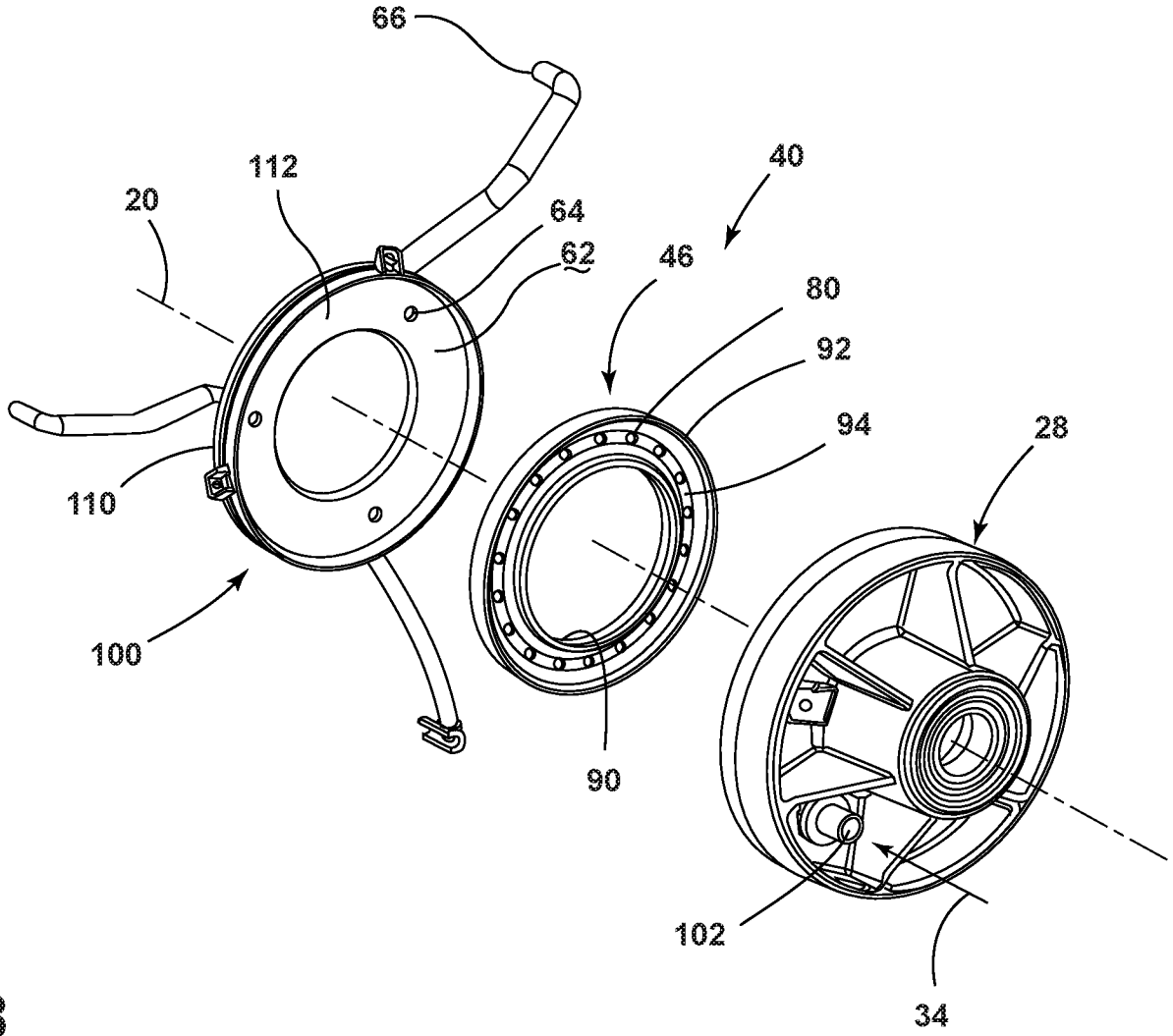
FIG. 8 is an exploded perspective view of the fluid delivery ring of FIG. 7.
Figure 9:
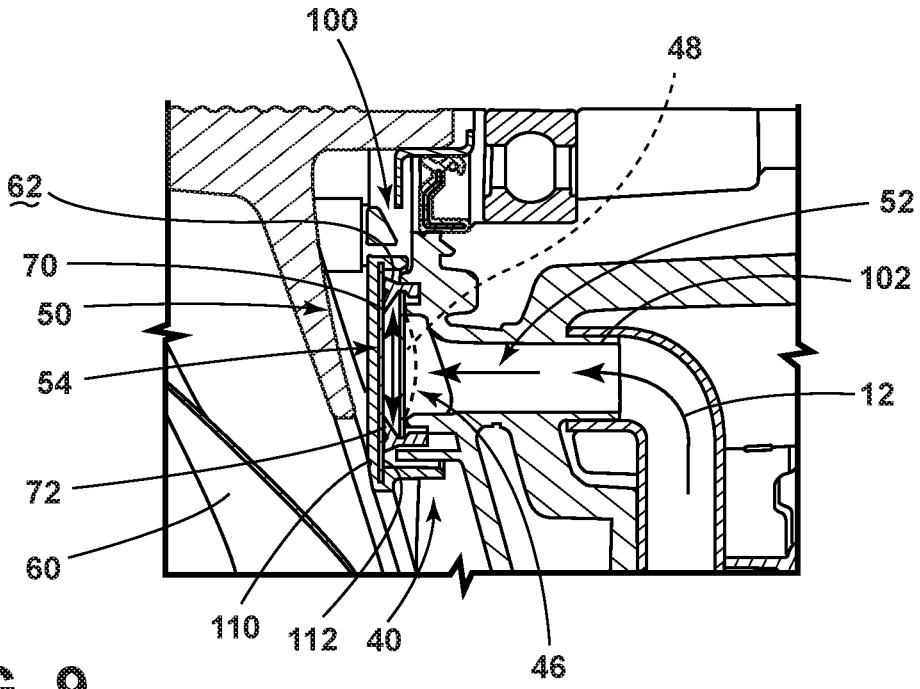
FIG. 9 is an enlarged cross-sectional view of the fluid delivery ring and defining a fluid channel therein.
Figure 10:
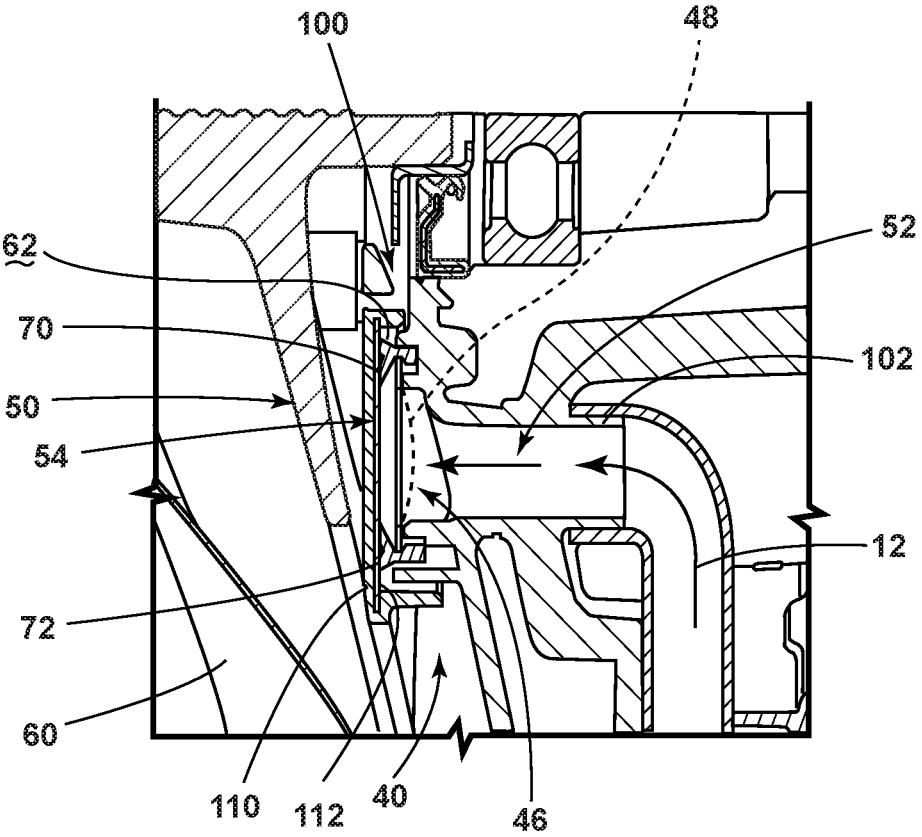
FIG. 10 is an enlarged cross-sectional view of the fluid delivery ring of FIG. 9.
Figure 11:
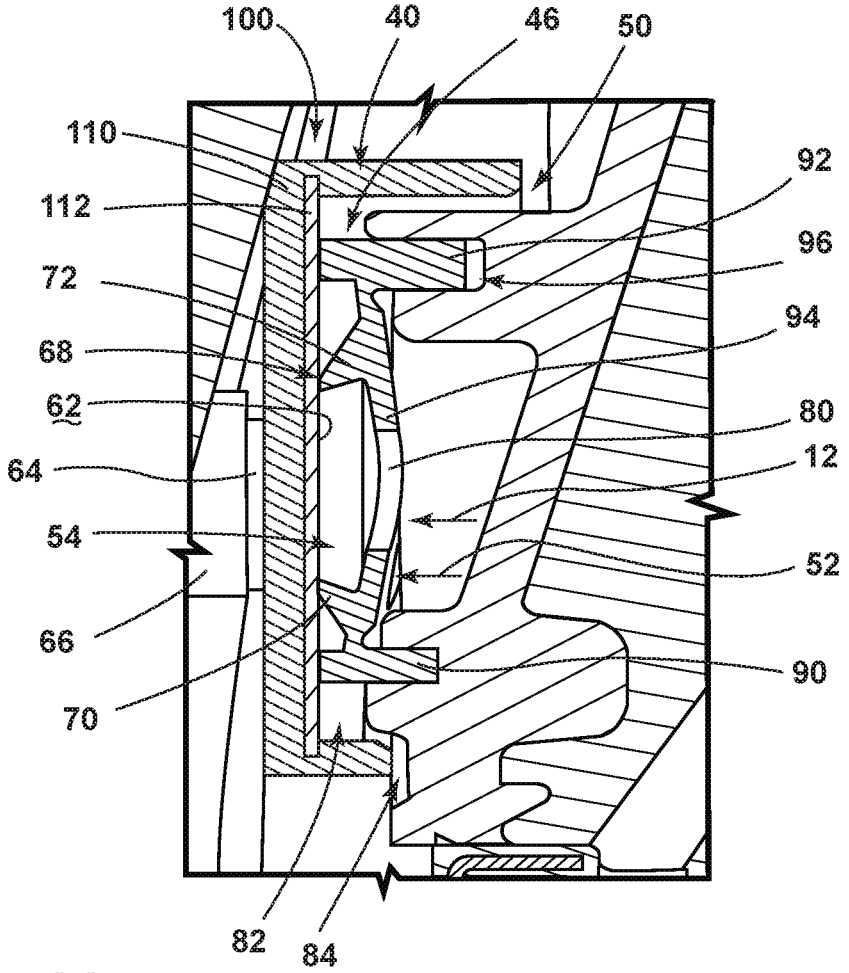
FIG. 11 is an enlarged cross-sectional view of the fluid delivery ring showing the gasket in a rest position.
Figure 12:
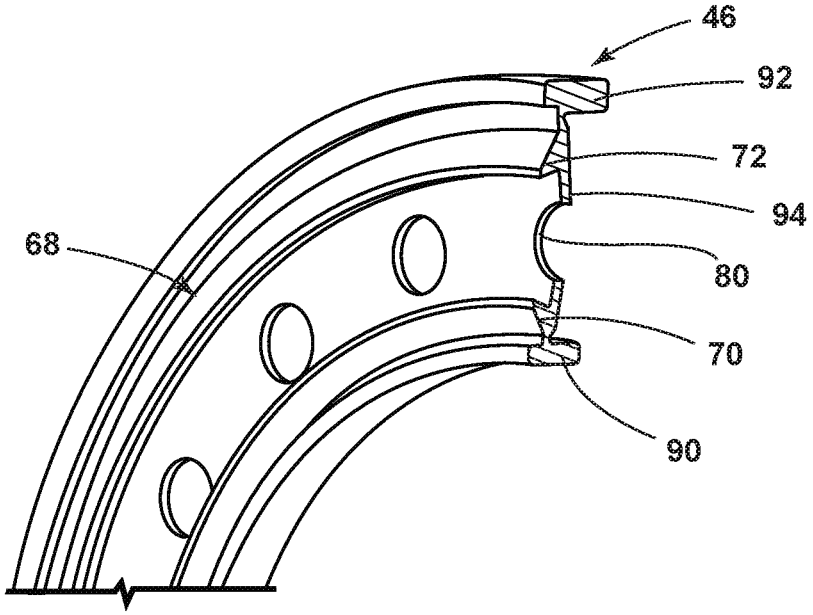
FIG. 12 is a cross-sectional perspective view of an interior gasket used within the fluid delivery ring.

The components in the figures are not necessarily to scale, emphasis instead being placed upon illustrating the principles described herein.

DETAILED DESCRIPTION

The present illustrated embodiments reside primarily in combinations of method steps and apparatus components related to a laundry appliance having a fluid delivery system that delivers fluid in a generally horizontal direction into a tub. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

With respect to FIGS. 1-44, reference numeral 10 generally refers to a fluid delivery path for delivering fluid 12 through a laundry appliance 14, typically a front-load laundry appliance 14. The laundry appliance 14 includes a drum 16 that is rotationally operable within a tub 18. The drum 16 is rotational about a generally horizontal rotational axis 20. In certain instances, the drum 16 and tub 18 may be positioned at an angle within the front-load laundry appliance 14. In such a condition, the rotational axis 20 may be generally horizontal, but at an angle with respect to a horizontal plane. A plurality of lifters 22 are coupled to an interior surface 24 of the drum 16. The fluid delivery path 10 is at least partially defined within the drum 16 and the plurality of lifters 22. In various aspects of the device, the fluid delivery path 10 may be defined between the plurality of lifters 22 and the interior surface 24 of the drum 16. A fluid delivery system 26 is configured to deliver fluid 12 into the fluid delivery path 10 in a direction parallel to the generally horizontal rotational axis 20. Accordingly, this fluid delivery system 26 can deliver fluid 12 into the fluid delivery path 10 at various locations with respect to the tub 18, the drum 16 and a structural hub 28 of the tub 18. Once the fluid 12 is delivered into the fluid delivery path 10 and past at least the rear wall 30 of the tub 18, the fluid delivery path 10 directs the fluid 12 to one or more of the plurality of lifters 22 that are positioned within the drum 16 for the laundry appliance 14.

Referring now to FIGS. 1-15, the laundry appliance 14 includes the drum 16 that is rotationally operable within the tub 18. The tub 18 rotates about the generally horizontal axis within the tub 18 for providing various agitating patterns and sequences to laundry that is disposed within the drum 16. The plurality of lifters 22 are positioned at the interior surface 24 of the drum 16 and typically attach to the cylindrical wall 32 of the drum 16. A fluid delivery ring 40 is defined between the tub 18 and the drum 16. The fluid delivery ring 40 is oriented concentrically around a drive shaft 42 that extends between the drum 16 and a motor 44 or rotor for the laundry appliance 14. An interior gasket 46 is operably positioned within the fluid delivery ring 40 that is defined between the tub 18 and the drum 16. The interior gasket 46, in a rest state 48, is minimally engaged with, or disengaged from, the drum 16. The rest state 48 is defined when little to no fluid 12 is delivered into the fluid delivery ring 40. Stated another way, the rest state 48 of the fluid delivery ring 40 is defined by little or no fluid 12 being delivered to the lifters 22 for the laundry appliance 14. In a channel state 50, fluid 12 is delivered into the fluid delivery ring 40. As the fluid 12 moves through the fluid delivery ring 40, a back pressure 52 of the fluid 12 engages the interior gasket 46 and biases the interior gasket 46 against the drum 16. Through the use of the back pressure 52 of the fluid 12, the interior gasket 46 engages the drum 16 and defines a sealed fluid channel 54 within the fluid delivery ring 40, between the interior gasket 46 and the drum 16. During this channel state 50, fluid 12 is able to be delivered through the fluid channel 54 of the fluid delivery ring 40 and to the lifters 22 that are positioned within the drum 16.

Referring again to FIGS. 4 and 5, the fluid delivery ring 40 is defined between the drum 16 and the tub 18. A back wall 60 of the drum 16 includes a concentric engaging surface 62 that extends around the drive shaft 42 for the drum 16. This engaging surface 62 includes a plurality of channel apertures 64 that allow fluid 12 to move from the fluid channel 54 and through fluid conduits 66 that extend from the fluid delivery ring 40 to each of the lifters 22. The interior gasket 46 includes at least one and typically a pair of concentric lips 68. In the rest state 48, these concentric lips 68, typically inner and outer lips 70, 72, minimally engage the engaging surface 62 of the drum 16 or are set apart from the engaging surface 62 of the drum 16. In this rest state 48, typically no fluid 12 is being delivered to the fluid delivery ring 40.

As the fluid 12 is directed into the fluid delivery ring 40, the back pressure 52 of the fluid 12 biases the inner and outer lips 70, 72 against the engaging surface 62 of the drum 16. This engagement between the inner and outer lips 70, 72 and the drum 16 forms the sealed or substantially sealed fluid channel 54 through which the fluid 12 can be delivered through the channel apertures 64, into the fluid conduits 66 and toward the lifters 22.

Referring now to FIGS. 7-13, the rest state 48 of the fluid delivery ring 40 can be utilized when the drum 16 is rotating, typically at a relatively high rate of speed, with respect to the drum 16. In the rest state 48, the inner and outer lips 70, 72 are minimally engaged with or are set apart from the engaging surface 62 of the drum 16. This minimal engagement of the inner and outer lips 70, 72 typically occurs in the absence of the fluid 12 or in the absence of a sufficient back pressure 52 to bias the inner and outer lips 70, 72 against the engaging surface 62. Accordingly, rotation of the drum 16, including the engaging surface 62, does not cause unnecessary wear and potential damage to the inner and outer lips 70, 72 of the interior gasket 46 of the fluid delivery ring 40. This rest state 48 may also be utilized during agitating portions or other slower rotational movements of the drum 16 with respect to the tub 18.

In this rest state 48, fluid 12, such as residual fluid 12, that may be within the fluid delivery ring 40, can move through gasket apertures 80 that extend through the interior gasket 46 and into a channel area 82 defined between the inner and outer lips 70, 72. In the rest state 48, because the inner and outer lips 70, 72 are minimally engaged with or not engaged with the engaging surface 62 of the drum 16, fluid 12 moving through the gasket apertures 80 may be allowed to flow outside of the inner and outer lips 70, 72 and through a bypass channel 84 that is defined between the drum 16 and the tub 18. This bypass channel 84 typically surrounds the fluid delivery ring 40 and allows for fluid 12 to move into the tub 18 during the rest state 48. In the rest state 48, minimal back pressure 52 of any fluid 12 moving into the fluid delivery ring 40 directs the fluid 12 through the gasket apertures 80. This minimal back pressure 52 may be insufficient to define the channel state 50. Accordingly, this residual fluid 12 may flow past the inner and outer lips 70, 72 and out the bypass channel 84, rather than through the channel apertures 64 and into the fluid conduit 66. Accordingly, any residual fluid 12 that may pass into the fluid delivery ring 40 may not be delivered into the lifters 22. Typically, in the rest state 48 of the fluid delivery ring 40, no fluid 12 is delivered through the fluid delivery path 10 that includes the fluid delivery ring 40.

As exemplified in FIGS. 9-13, the channel state 50 of the fluid delivery ring 40 is typically defined during situations where the drum 16 is stationary or moving slowly with respect to the tub 18. In these situations, back pressure 52 of the fluid 12 moving through the fluid delivery ring 40 is able to bias the interior gasket 46 toward the engaging surface 62 of the drum 16. At the same time, the gasket apertures 80 defined within the interior gasket 46 allow for fluid 12 to move through the fluid delivery ring 40 and into the fluid channel 54 defined between the inner and outer lips 70, 72 of the interior gasket 46. The inner and outer lips 70, 72 are concentrically positioned within the fluid delivery ring 40 and define the fluid channel 54 in the channel state 50 and the unsealed channel area 82 in the rest state 48. The channel apertures 64 that extend through the engaging surface 62 and into the fluid conduits 66 are contained within the fluid channel 54 in the channel state 50. Accordingly, back pressure 52 of the fluid moving through the fluid delivery ring 40 is able to focus the back pressure 52 of the fluid 12 through the fluid channel 54, into the channel apertures 64 and into the fluid conduits 66 for delivery to the lifters 22. In this manner, during the channel state 50 of the fluid delivery ring 40, back pressure 52 of the fluid 12 biases the inner and outer lips 70, 72 against the engaging surface 62 of the drum 16 and also pushes the fluid 12 through the fluid channel 54 and into the fluid conduit 66 for delivery to the lifters 22.

Figure 13:
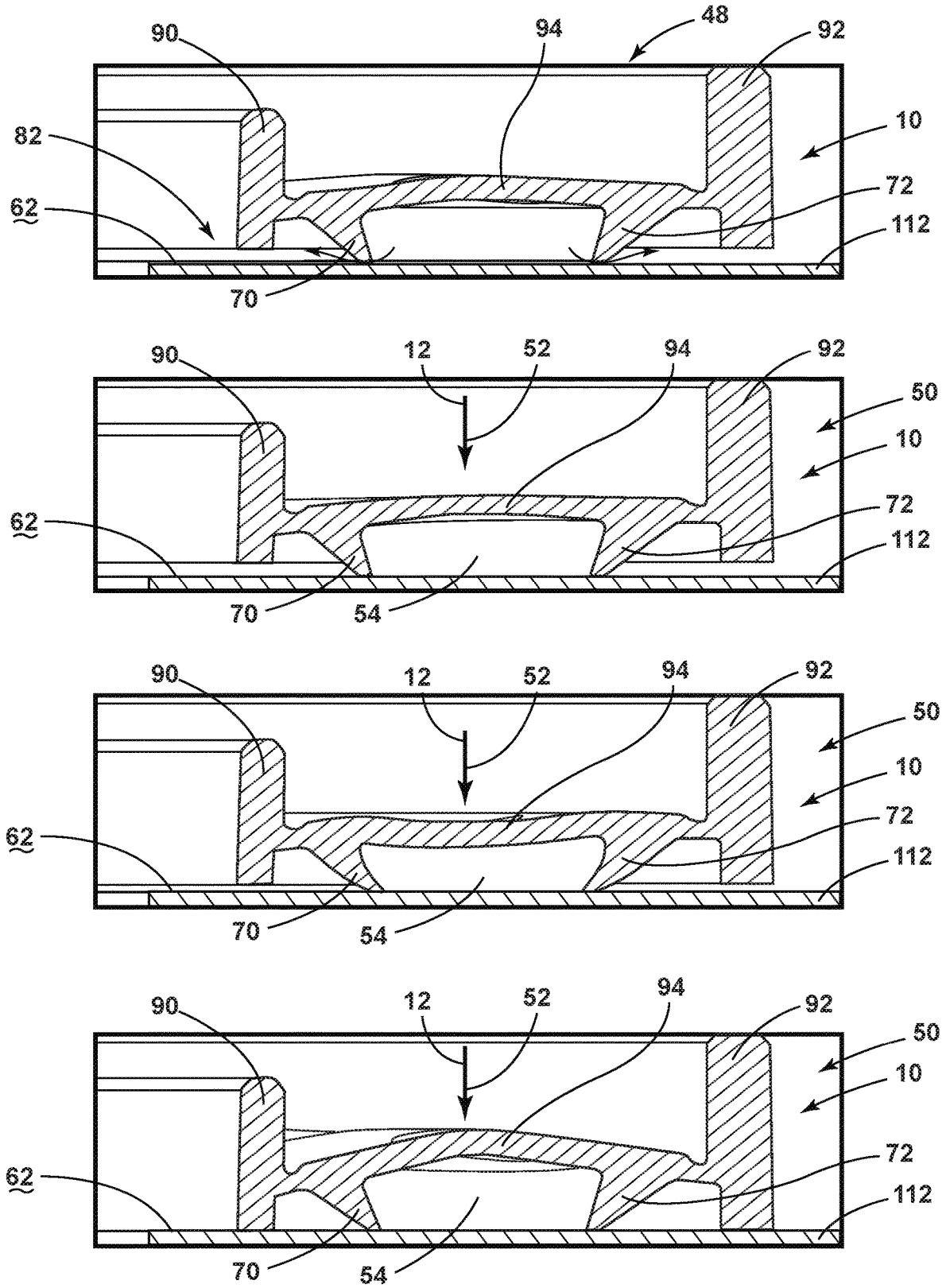
FIG. 13 is an image progression showing operation of the interior gasket between a rest position and a channel position that is operated by a back pressure of fluid moving through the fluid delivery ring.
Figure 14:
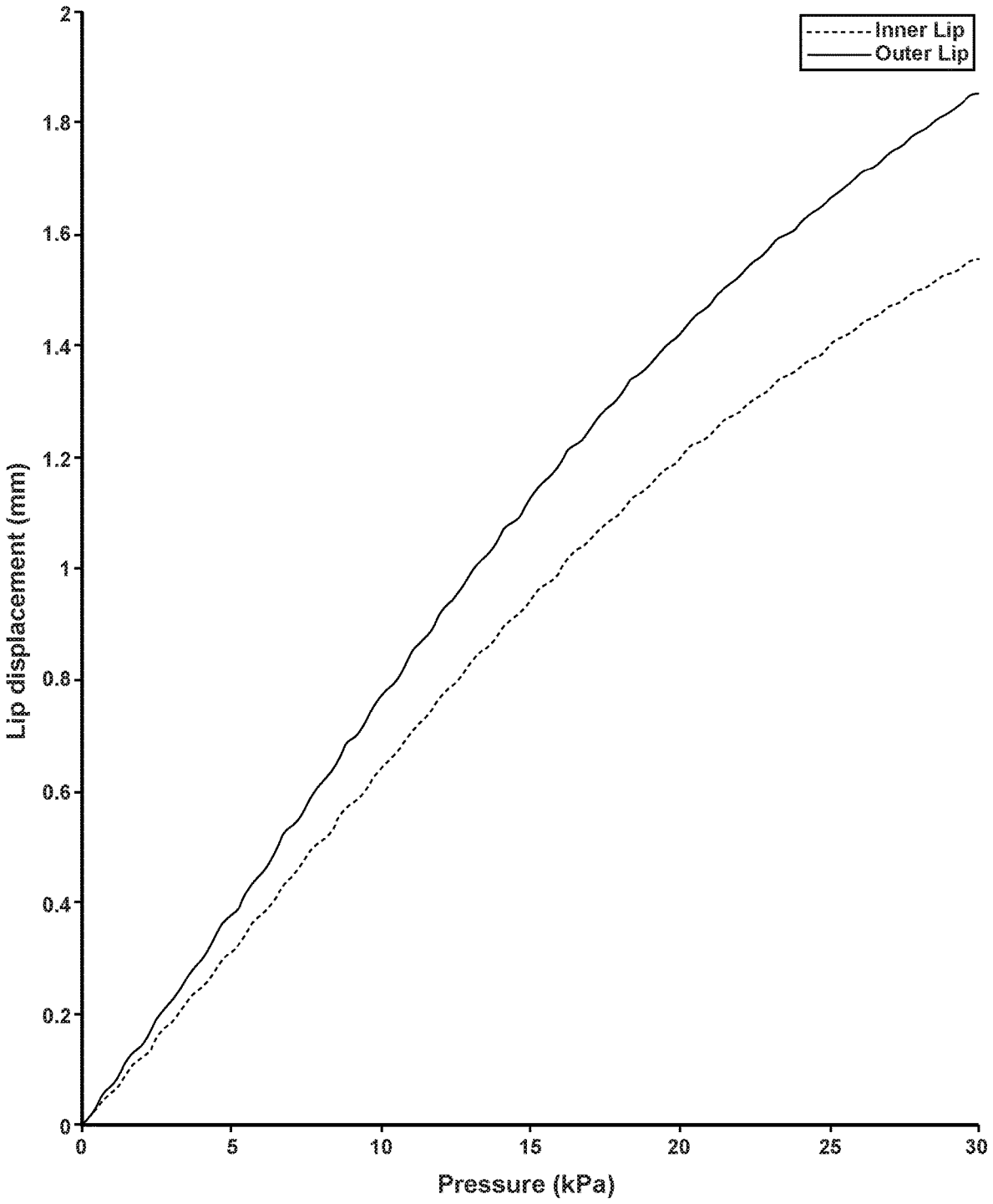
FIG. 14 is a schematic diagram illustrating inner and outer lip displacement with respect to fluid pressure provided into the fluid delivery ring.
Figure 15:
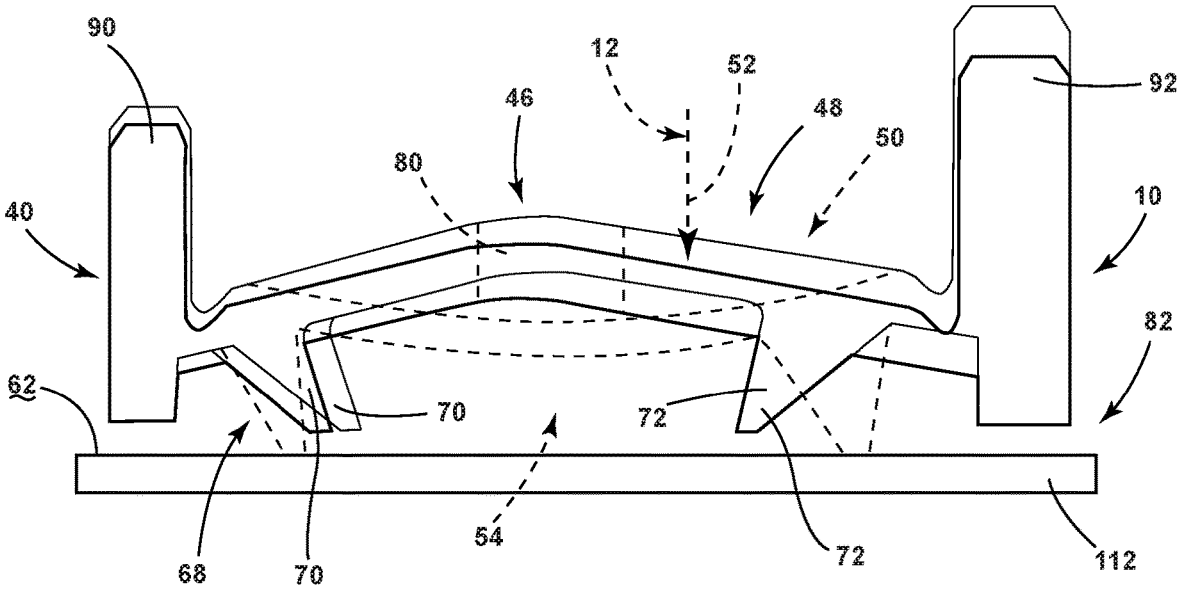
FIG. 15 is a schematic cross-sectional view of several interior gasket configurations that may be used within aspects of the fluid delivery ring.
Figure 16:
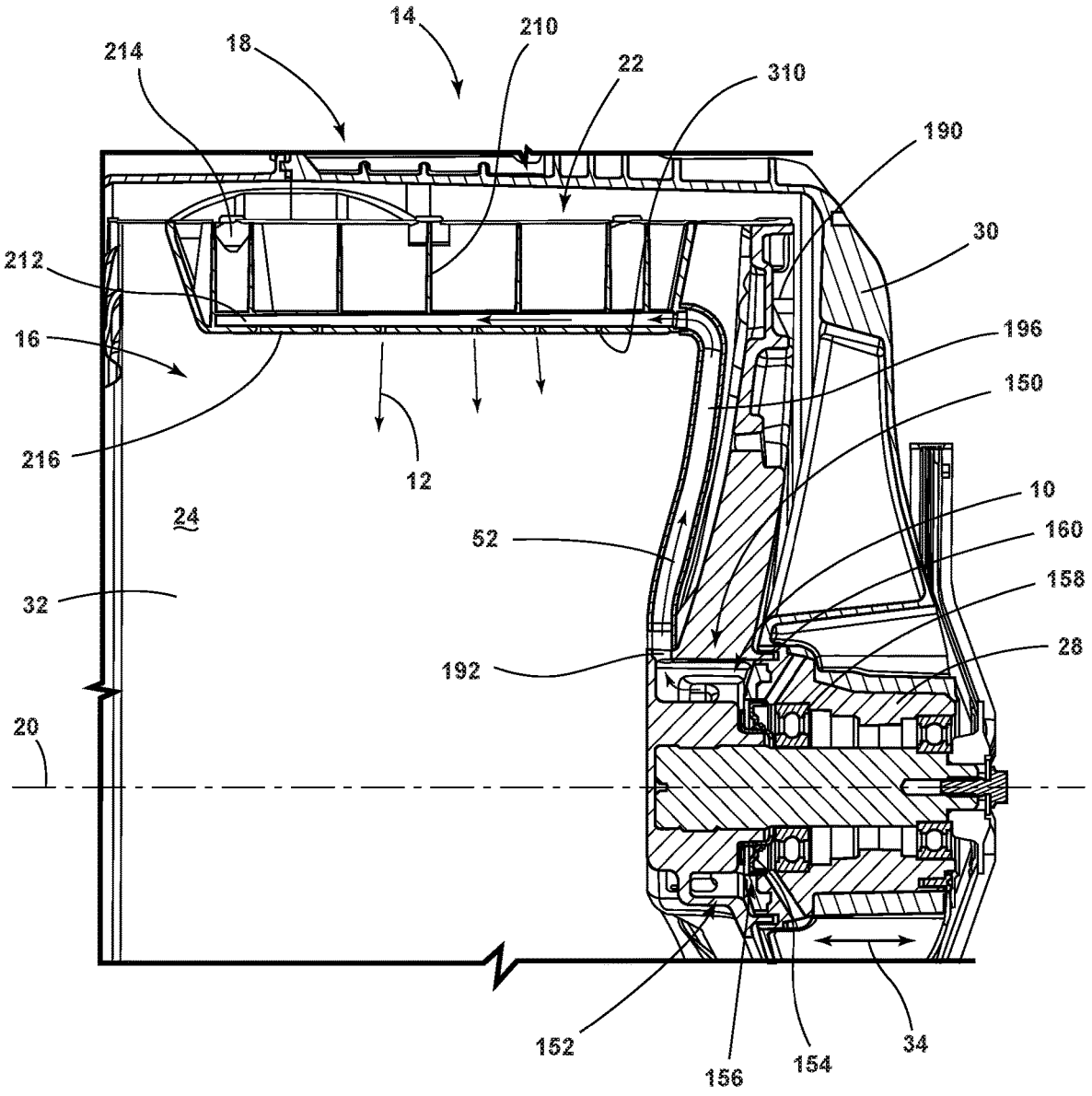
FIG. 16 is a cross-sectional view of an appliance incorporating an aspect of the fluid delivery path.
Figure 17:
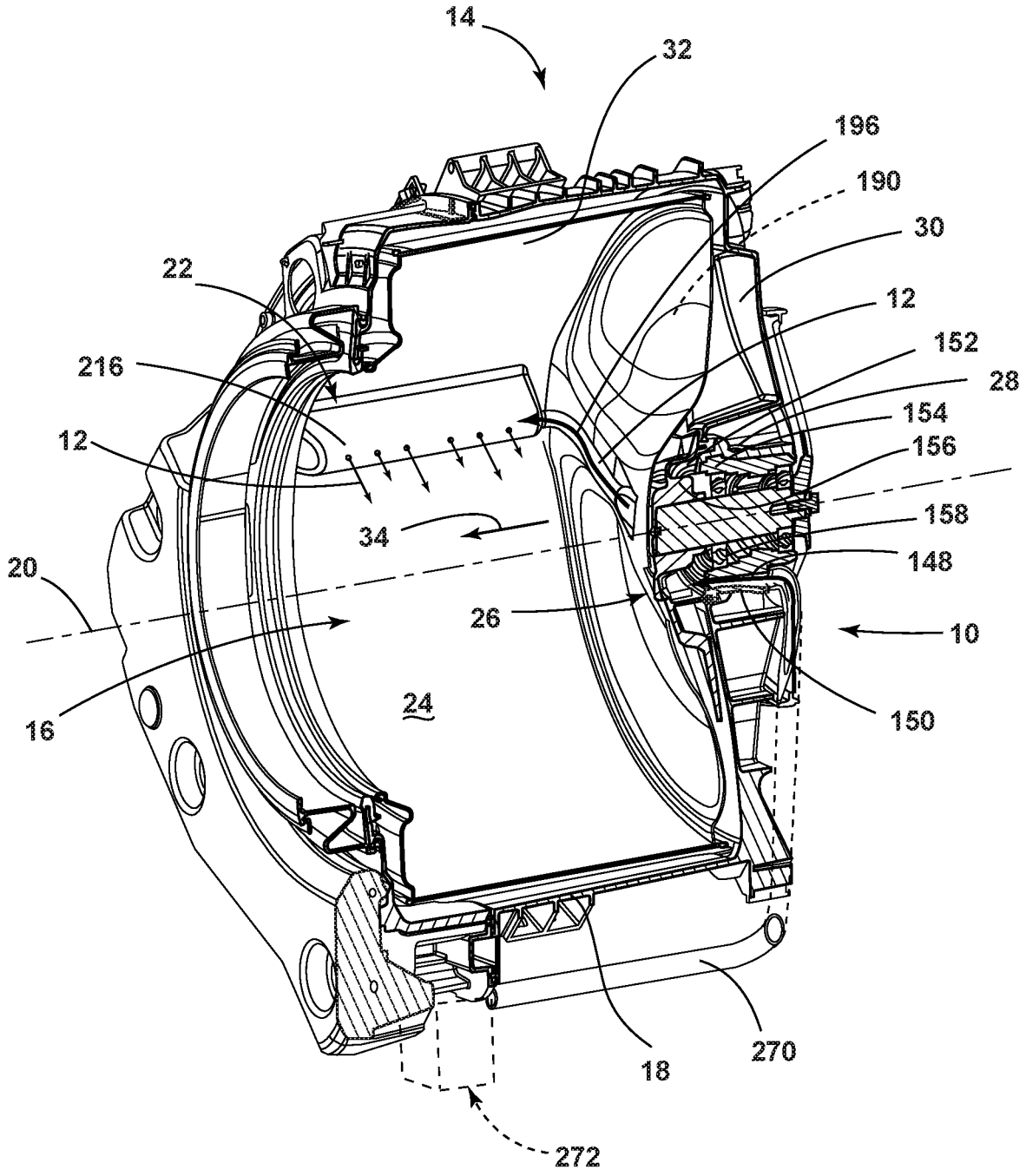
FIG. 17 is a cross-sectional perspective view of the laundry appliance of FIG. 16.
Figure 18:
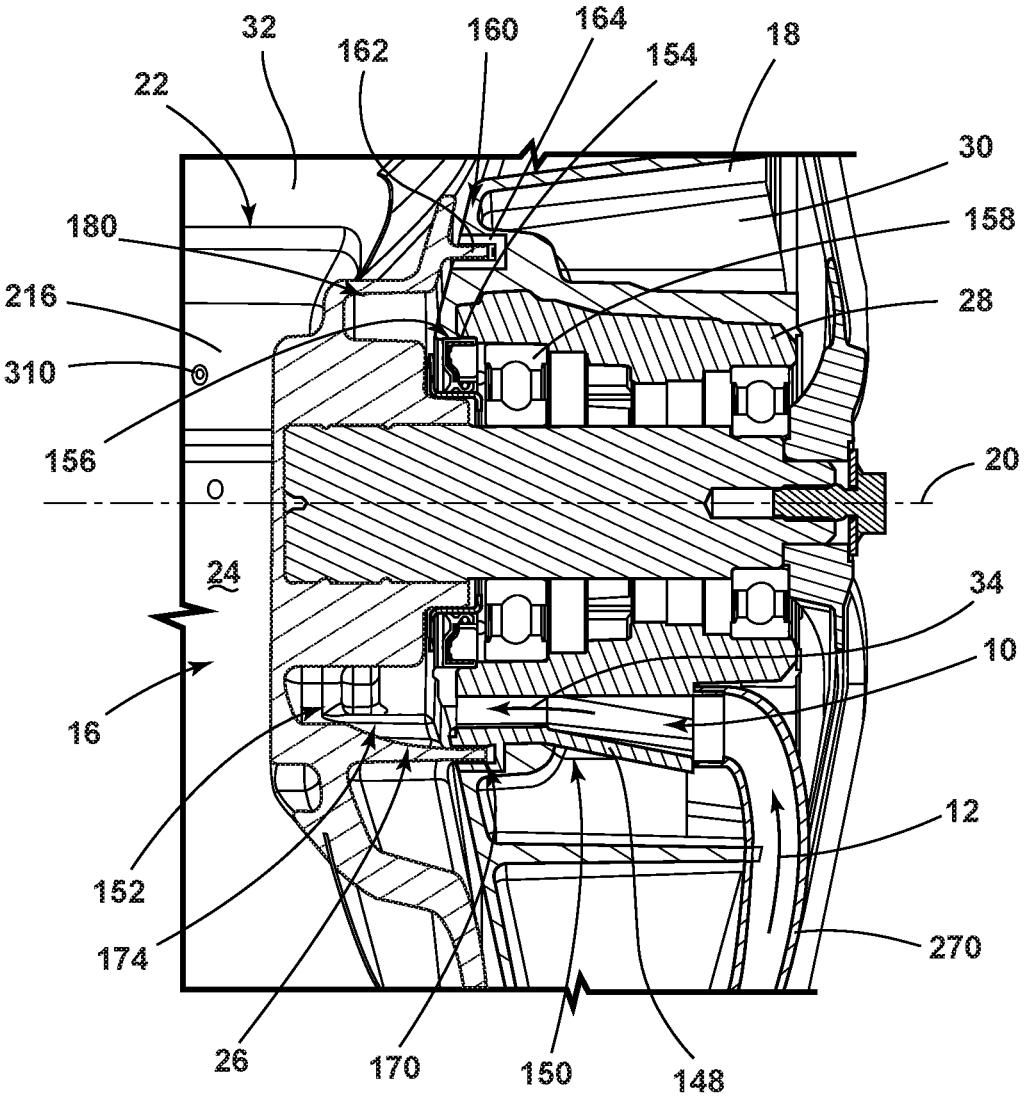
FIG. 18 is an enlarged cross-sectional view of a laundry appliance showing the fluid delivery path that incorporates a fluid space that is bound by a concentric flange.
Figure 19:
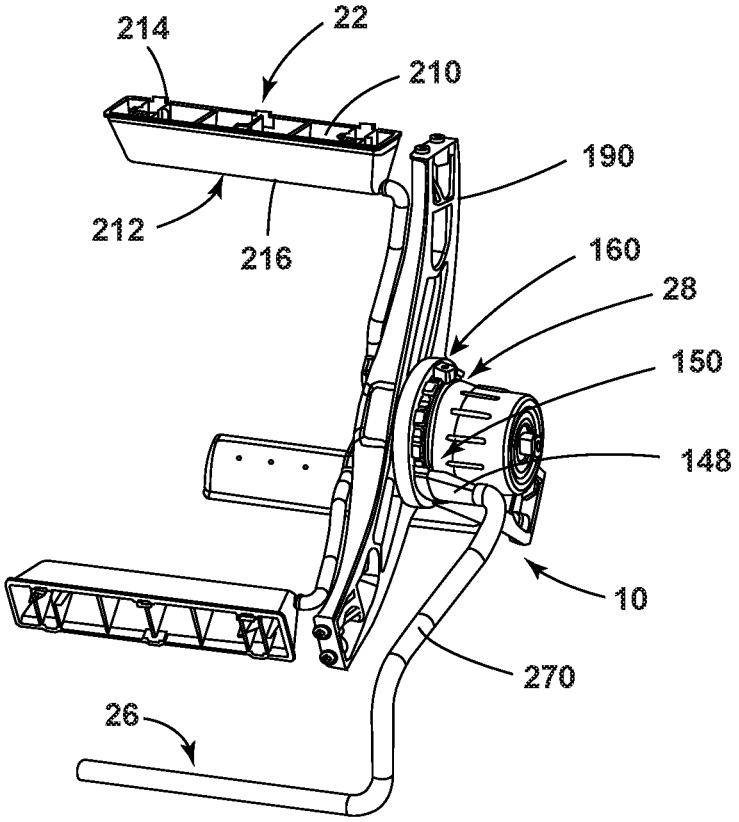
FIG. 19 is a side perspective view of an aspect of the fluid delivery system of FIG. 16.
Figure 20:
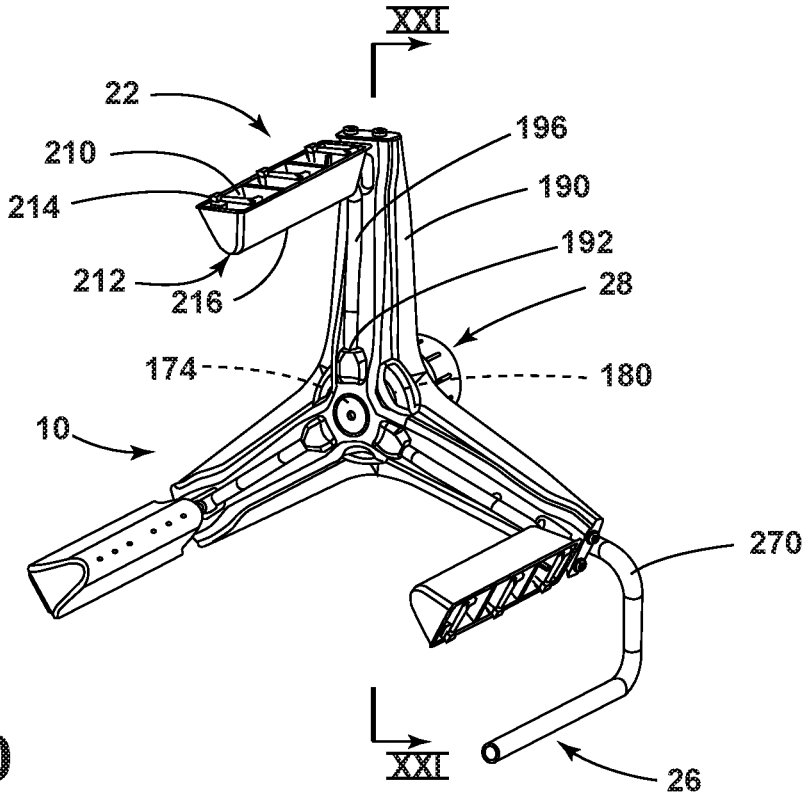
FIG. 20 is a front perspective view of the fluid delivery system of FIG. 19.
Figure 21:
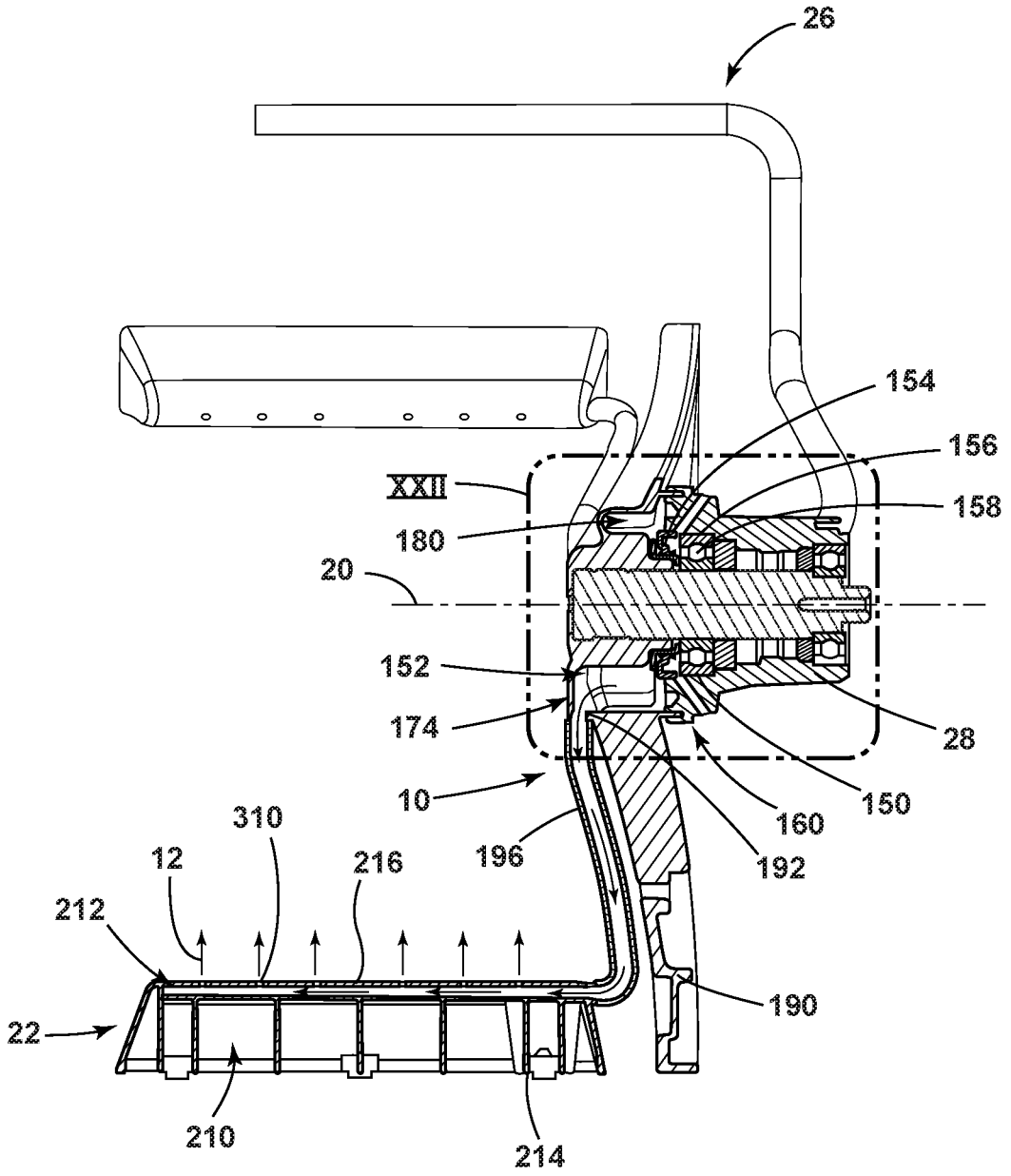
FIG. 21 is a schematic cross-sectional view of the fluid delivery system of FIG. 20, taken along line XXI-XXI.
Figure 22:
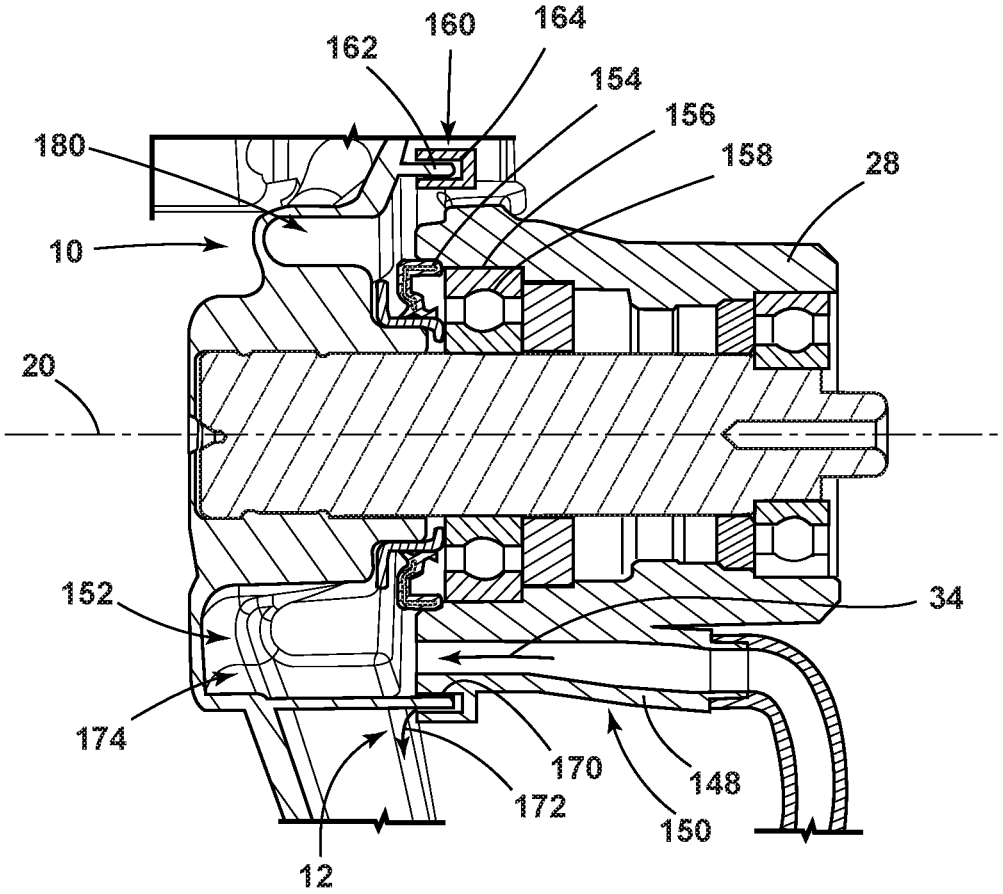
FIG. 22 is an enlarged cross-sectional view of the fluid delivery system of FIG. 21, taken at area XXII.

As exemplified in FIGS. 13 and 14, greater back pressure 52 exerted by the fluid 12 moving through the fluid delivery ring 40 increases the displacement of the inner and outer lips 70, 72 with respect to the engaging surface 62 of the drum 16. Typically, the inner lip 70 may experience a lesser displacement as a result of the back pressure 52 from the fluid 12. Conversely, the outer lip 72 may experience a greater displacement based upon a similar back pressure 52 provided through the fluid delivery ring 40. Additionally, as exemplified in FIG. 15, various configurations of the interior gasket 46 and the inner and outer lips 70, 72 are contemplated. These differing configurations typically have minor modifications to the various structures of the interior gasket 46. The overall operation of the interior gasket 46 is similar, where back pressure 52 of fluid 12 moving through the fluid delivery ring 40 biases the inner and outer lips 70, 72 toward the engaging surface 62 of the drum 16. This movement of the inner and outer lips 70, 72 serves to seal the fluid channel 54 to allow for fluid 12 to move into the fluid delivery ring 40, through the fluid channel 54 and into the fluid conduit 66 for delivery to the lifters 22.

As exemplified in FIGS. 9-13 and 15, the interior gasket 46 can include inner and outer concentric mounts 90, 92 that engage with a rear wall 30 of the tub 18 and/or the structural hub 28 that is coupled with the tub 18. Typically, the hub 28 is a metallic member. A gasket membrane 94 extends between the inner and outer concentric mounts 90, 92. The rear wall 30 of the tub 18, and/or the structural hub 28 can include gasket seats 96 that receive and secure the inner and outer concentric mounts 90, 92 for holding the interior gasket 46 in position relative to the engaging surface 62. The inner and outer concentric mounts 90, 92 are configured to remain stationary within the gasket seats 96. Conversely, the gasket membrane 94, using the back pressure 52 of the fluid 12, is able to flex between the rest and channel states 48, 50. The gasket apertures 80 are defined within the gasket membrane 94 and the inner and outer lips 70, 72 extend outward from the gasket membrane 94 and toward the engaging surface 62 of the drum 16. The number of gasket apertures 80 defined within the gasket membrane 94 can vary depending upon various design considerations of the laundry appliance 14. The number of gasket apertures 80 are sufficient to allow fluid 12 to move into the fluid channel 54 in the channel state 50. The number of gasket apertures 80 are also minimal enough to provide a sufficient surface area of the gasket membrane 94 against which the fluid 12 can exert the back pressure 52 for biasing the interior gasket 46 toward the engaging surface 62 of the drum 16 to form the fluid channel 54.

The engaging surface 62 of the drum 16 can be an integrally formed portion of the material of the drum 16, such as an injection molded engaging surface 62. Alternatively, the engaging surface 62 of the drum 16 can be a chamber ring 100 that is attached to the back wall 60 of the drum 16 and positioned around the drive shaft 42. In either instance, the fluid conduits 66 that extend between the lifters 22 and the engaging surface 62 of the drum 16 attach to the channel apertures 64 that are defined within and through the engaging surface 62. The chamber ring 100 of the fluid delivery ring 40 is aligned with a portion of the rear wall 30 of the tub 18 for defining the fluid delivery ring 40. A primary inlet 102 extends from a fluid pump 272 via an inlet conduit 270 and engages with the rear wall 30 of the tub 18. Typically, this primary inlet 102 will be attached to a portion of the hub 28 and extends through the hub 28 and into the fluid delivery ring 40. In various aspects of the device, the primary inlet 102 may extend through a portion of the tub 18 as well as the hub 28, or may extend only through the tub 18 and bypass the hub 28.

The chamber ring 100 of the fluid delivery ring 40 that is coupled with or defined within the drum 16 can include an outer housing 110. The engaging surface 62 can be a separate engaging plate 112 that is positioned within the outer housing 110 to define a low-friction engaging surface 62 that can receive and seal against the inner and outer lips 70, 72 of the interior gasket 46 in the channel state 50. In various aspects of the device, the interior gasket 46 can seal directly against an engaging surface 62 defined by the outer housing 110 where no separate engaging plate 112 is included. Where an engaging plate 112 is included, typically this engaging plate 112 will be a rigid member that can be metallic, ceramic, plastic, composite or other similar rigid material, and that is set within the plastic housing of the chamber ring 100 for the fluid delivery ring 40.

In this configuration of the fluid delivery path 10, fluid 12 is delivered through the fluid delivery ring 40 and extends through the fluid channel 54 around the drive shaft 42. Within the fluid delivery ring 40, the back pressure 52 of the fluid 12 allows for the fluid 12 to be apportioned between the lifters 22 substantially equally. Small variations within the amount of fluid 12 or back pressure 52 of fluid 12 delivered through the lifters 22 may vary depending upon the rotational position of each of the lifters 22. In other words, a lifter 22 positioned at a top portion 120 of the rotational path of the drum 16 may experience a lower pressure than lifters 22 positioned at a bottom portion 122 of the rotational path of the drum 16. This variation in pressure may be a result of gravitational forces. The use of the fluid delivery ring 40 can provide a sufficient back pressure 52 of fluid 12 to form the fluid channel 54 such that fluid 12 can be delivered, contemporaneously, to each of the lifters 22 during operation of the laundry appliance 14 in the channel state 50.

The primary inlet 102 through the tub 18 is typically aligned with a portion of the interior gasket 46. In various aspects of the device, a plurality of primary inlets 102 may be positioned around the fluid delivery ring 40, where each primary inlet 102 is able to deliver a portion of the fluid 12 into the fluid delivery ring 40. It is also contemplated that the primary inlet 102 may include a single primary inlet 102 that delivers fluid 12 into the fluid delivery ring 40.

According to various aspects of the device, the interior gasket 46 is fixed with respect to the tub 18 and hub 28. The drum 16 and the engaging surface 62 that is integral with or is attached to the drum 16 rotationally operates with respect to the interior gasket 46. Accordingly, sliding operation between the interior gasket 46 and the engaging surface 62 of the drum 16 is utilized during the rest state 48 of the interior gasket 46 of the fluid delivery ring 40. In the rest state 48, there is minimal engagement between the inner and outer lips 70, 72 and the engaging surface 62 of the drum 16, or no engagement therebetween. This configuration provides for a minimal amount of wear and tear between the inner and outer lips 70, 72 of the interior gasket 46 and the engaging surface 62 of the drum 16. Additionally, this configuration may extend the life of the various components of the interior gasket 46 and the fluid delivery system 26 for delivering fluid 12 to the lifters 22 of the drum 16.

Referring now to FIGS. 1, 2 and 16-25, the front-load laundry appliance 14 includes the drum 16 that is rotationally operable within the tub 18. The lifters 22 are disposed on the interior surface 24 of the drum 16 and fluid 12 is delivered to the drum 16 via the lifters 22 that are attached to a cylindrical wall 32 of the drum 16. The structural hub 28 of the tub 18 includes an outer portion 150 that defines a primary fluid inlet 148 that extends to a concentric fluid space 152 defined between the tub 18 and the drum 16. This concentric fluid space 152 is defined by a bearing seal 154 at an inner portion 156, where this bearing seal 154 typically prevents infiltration of fluid 12 into bearings 158 that extend between the drive shaft 42 and the hub 28. At the outer portion 150 of the hub 28, the concentric fluid space 152 includes a labyrinth seal 160 that is defined between a concentric flange 162 of the drum 16 and a concentric channel 164 defined within a portion of the hub 28. In this manner, the concentric fluid space 152 is typically positioned near the drive shaft 42 and is configured to provide fluid 12 through fluid conduits 66 to the various lifters 22 that are coupled with the drum 16 for the laundry appliance 14. The primary inlet 102 for the fluid delivery system 26 is coupled with the fluid inlet 148 of the hub 28 and provides fluid 12 for substantially filling the concentric fluid space 152 defined between the drum 16 and the tub 18. By filling the concentric fluid space 152, a back pressure 52 of fluid 12 can be used to provide a substantially consistent flow of fluid 12 through the various fluid conduits 66 and through the lifters 22 for providing fluid 12 into the drum 16 of the laundry appliance 14 during various laundry cycles.

Typically, the concentric fluid space 152 is in the form of a continuous concentric fluid space 152 that allows for the delivery of fluid 12 throughout. In such an embodiment, fluid 12 delivered into the concentric fluid space 152 is delivered to each of the fluid conduits 66 in a contemporaneous fashion so that fluid 12 can be delivered to the lifters 22 at substantially the same time.

As exemplified in FIGS. 21-25, the labyrinth seal 160 that is defined between the concentric flange 162 and the concentric channel 164 can include a minimal space 170 that can allow for leakage 172 of fluid 12 from the concentric fluid space 152. This leakage 172 can be used to control the pressure of the fluid 12 that is moving through enlarged reservoirs 174 that lead into the various fluid conduits 66 for delivery to the lifters 22. Where fluid 12 moves through the labyrinth seal 160, this fluid 12 is emptied into the tub 18 and can be drained with the remainder of the fluid 12 that is used during the various laundry cycles of the laundry appliance 14. The labyrinth seal 160 that is defined between the concentric flange 162 and the concentric channel 164 can have various dimensional tolerances that can be in a range of distances from approximately 0.2 millimeters to approximately 4 millimeters, and various dimensional tolerances therebetween.

Figure 23:
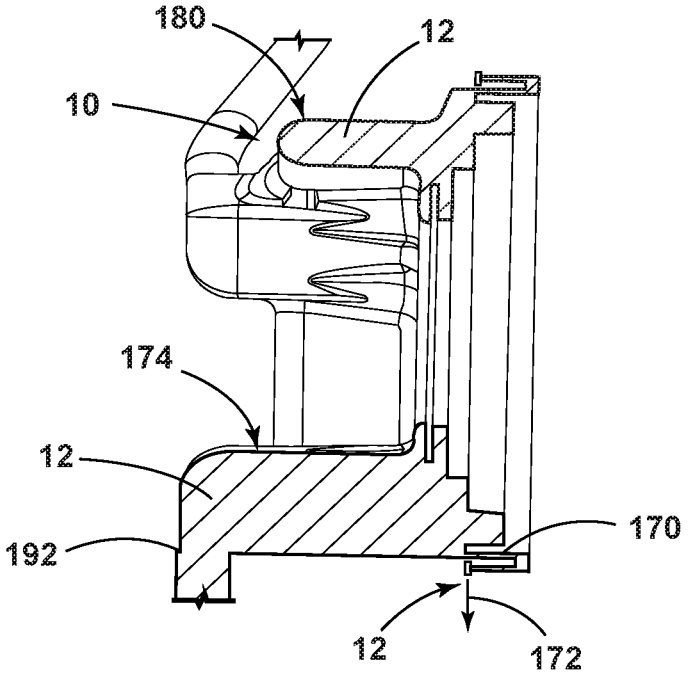
FIG. 23 is an enlarged cross-sectional view of the structural hub that forms a portion of the fluid delivery system.
Figure 24:
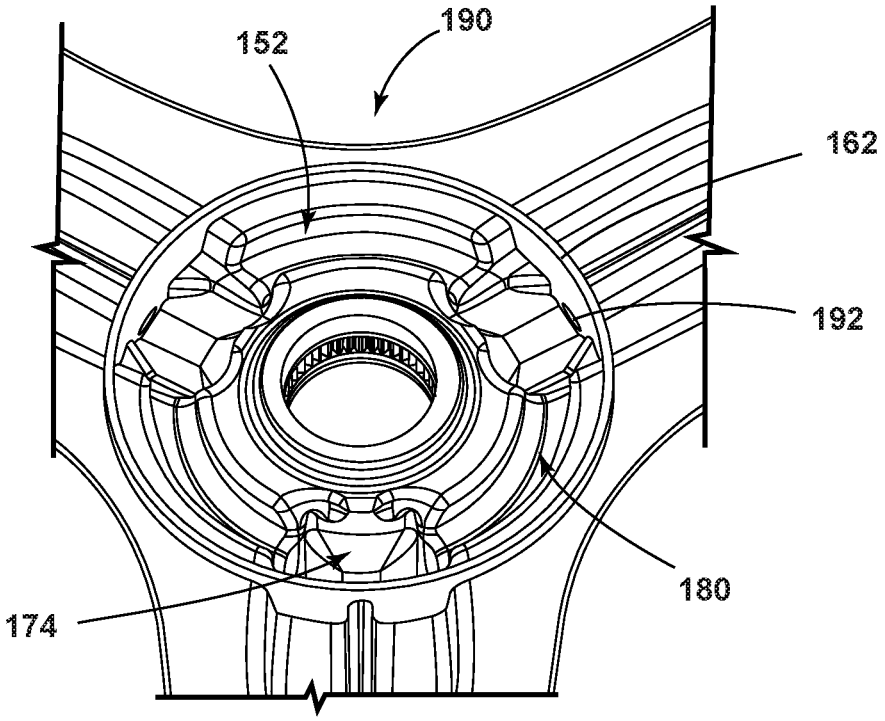
FIG. 24 is a rear perspective view of an aspect of the drum that forms a portion of the fluid space of the fluid delivery system.
Figure 25:
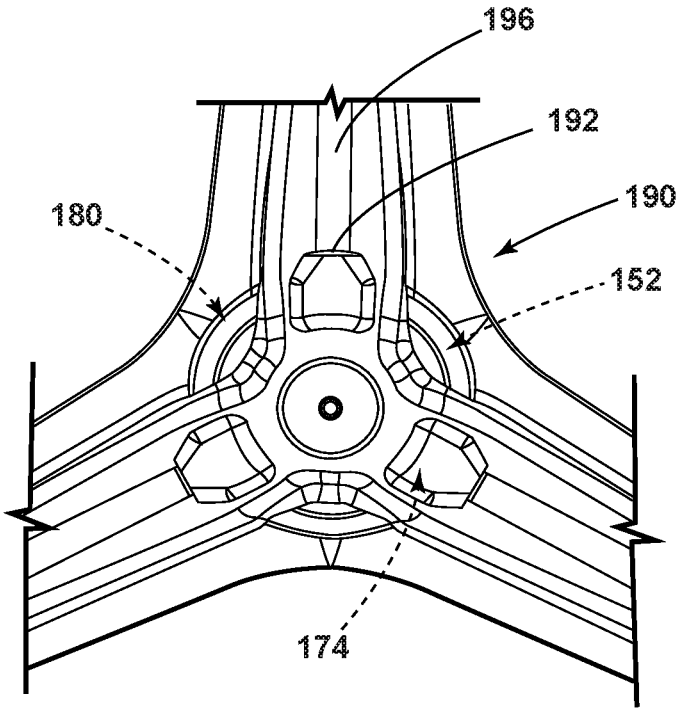
FIG. 25 is a front perspective view of a portion of the drum that forms the fluid delivery system.
Figure 26:
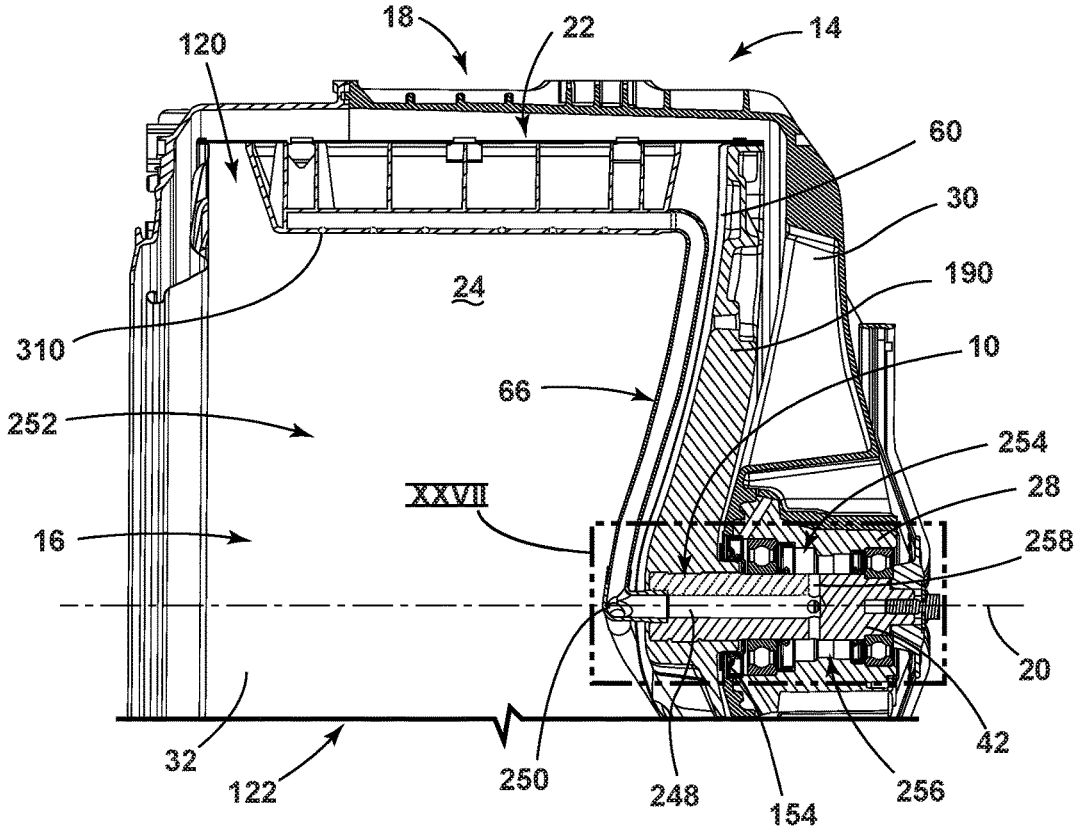
FIG. 26 is a cross-sectional view of an aspect of a laundry appliance that incorporates a fluid delivery system that moves axially through a drive shaft of the drum.
Figure 27:
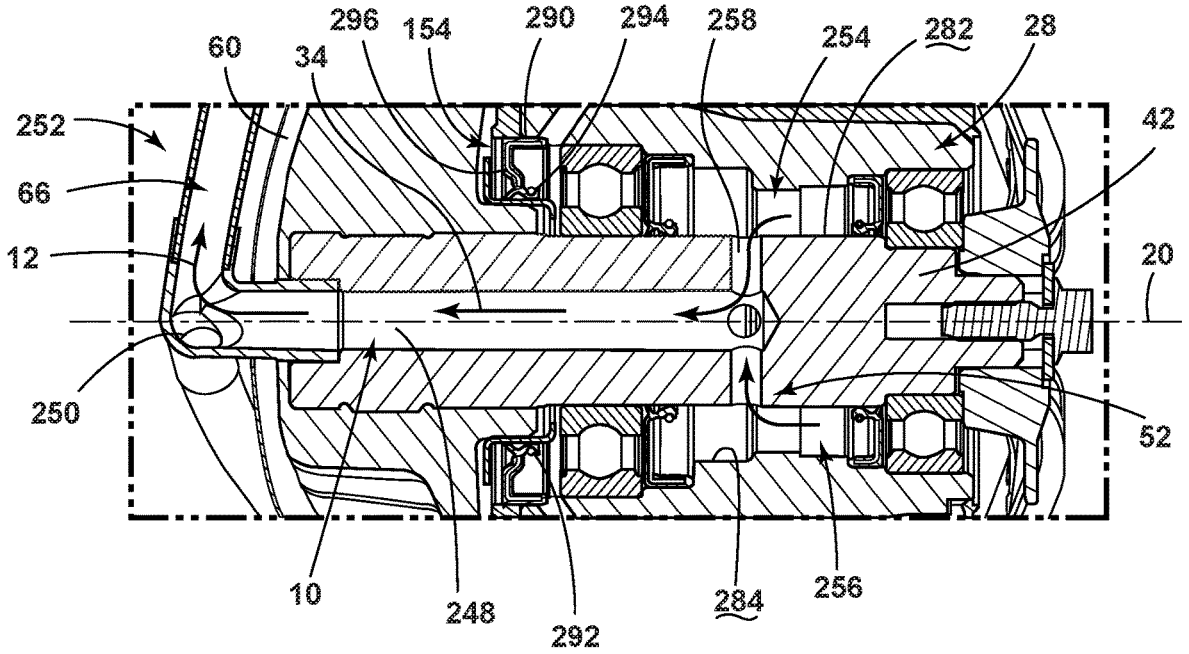
FIG. 27 is an enlarged cross-sectional view of the laundry appliance of FIG. 26 taken at area XXVII.

As exemplified in FIGS. 22-25, the movement of fluid 12 through the concentric fluid space 152 provides for the continuous and contemporaneous movement of fluid 12 through each of the fluid conduits 66 and each of the corresponding lifters 22 that are coupled with the fluid conduits 66. FIG. 23 is a schematic diagram illustrating the negative space defined by the concentric fluid space 152 within which the fluid 12 can be contained and delivered to the various lifters 22. Accordingly, the concentric fluid space 152 can include the enlarged reservoirs 174 and connecting channels 180 that extend between the enlarged reservoirs 174. The connecting channels 180 can be used to direct fluid 12 between the various enlarged reservoirs 174 so that the entire concentric fluid space 152 is occupied by fluid 12 and a consistent back pressure 52 of fluid 12 can be provided to the fluid conduits 66 and the various lifters 22.

As exemplified in FIGS. 18-25, the concentric fluid space 152 that is defined within a cross piece 190 of the drum 16 and within the concentric flange 162 can include various cross-sectional sizes that can utilize the back pressure 52 of fluid 12 for directing this fluid 12 into the fluid conduits 66. By way of example, and not limitation, the fluid port 192 that is defined through the concentric flange 162 and toward the fluid conduit 66 can have a diameter of within a range of from about 1 millimeter to approximately 8 millimeters and various dimensional tolerances therebetween.

Referring again to FIGS. 19-25, the lifter duct 196 that is defined within a top portion 120 of the cross piece 190 can extend from the fluid port 192 defined within the concentric flange 162 and can couple with a separate fluid conduit 66 or can define a continuous fluid conduit 66 that extends between the concentric fluid space 152 and the lifter 22.

According to various aspects of the device, the lifters 22 can include a structural portion 210 and a fluid portion 212. The structural portion 210 typically includes a base 214 that is coupled with the cylindrical wall 32 of the drum 16. The fluid portion 212 of the lifter 22 is typically defined at the outer edge 216 of the lifter 22 and is in communication with a fluid conduit 66 that extends from the fluid delivery path 10 proximate the drum 16 and the tub 18.

In various alternative aspects of the device, the lifters 22 can be configured to receive fluid 12 in a manner that the entire or substantially the entire lifter 22 is filled with fluid 12 for delivery into the tub 18. In such an embodiment, the outer structural portion 210 of the lifter 22 can be used to support the lifter 22 and attach to the drum 16. This outer structural portion 210 can also define the fluid portion 212 that may occupy substantially all of the interior or a portion of the interior of the lifter 22 for providing the fluid 12 into the drum 16 via the fluid delivery path 10.

The lifter duct 196 that extends from the concentric fluid space 152 and toward the fluid conduit 66 can have a larger cross-sectional diameter than the fluid port 192 defined within the concentric flange 162 that defines the concentric fluid space 152. The interior diameter of the lifter duct 196 may be within a range of from approximately 5 millimeters to approximately 12 millimeters. Similarly, the fluid conduit 66 that extends from the lifters 22 can have a wide range of interior diameters that can be within a range of from approximately 8 millimeters to approximately 20 millimeters, and various dimensional tolerances therebetween.

Referring now to FIGS. 1, 2 and 26-31, the front-load laundry appliance 14 can include the drum 16 that is rotationally operable within the tub 18. The lifters 22 are disposed on the interior surface 24 of the drum 16 and fluid 12 is delivered to the drum 16 via the lifters 22 that are attached to the cylindrical wall 32 of the drum 16. The fluid 12 is delivered to the lifters 22 through the primary inlet 102 that extends through the tub 18 and in an axial direction 34 parallel with a drive shaft 42 and the rotational axis 20 of the drum 16. According to various aspects of the device, the drive shaft 42 is attached to the drum 16 and the shaft inlet 248 extends axially through a portion of the drive shaft 42 to a manifold 250. This manifold 250 serves to apportion the fluid 12 among the various fluid conduits 66 and lifters 22 attached thereto. Typically, the manifold 250 is in the form of a three-way fitting that apportions the fluid 12 among the various lifters 22. The number of lifters 22 will typically correspond to the number of fittings of the manifold 250. As discussed above, the lifters 22 are attached to the cylindrical wall 32 of the drum 16 and extend toward the interior of the processing space 252 defined by the drum 16.

A plurality of bearings 158 are positioned between the drive shaft 42 and a structural hub 28 that is coupled with the tub 18. The fluid delivery path 10 includes a bearing space 254 that is defined between the drive shaft 42 and the hub 28 of the tub 18. The plurality of bearings 158 contain this bearing space 254 within a predefined circumferential fluid portion 256 of the area between the drive shaft 42 and the hub 28. This circumferential fluid portion 256 that is defined between the drive shaft 42 and the hub 28 can define the bearing space 254 for delivering fluid 12 to the shaft inlet 248.

As discussed above, the shaft inlet 248 extends axially through the drive shaft 42 and extends through the manifold 250 that is typically positioned at the end of the drive shaft 42. The primary inlet 102 that provides fluid 12 to the circumferential fluid space extending between the drive shaft 42 and the hub 28 can be positioned at an outer section of the hub 28. This primary inlet 102 typically extends generally perpendicular to the axial flow of fluid 12 toward the manifold 250 positioned at the end of the drive shaft 42. Through the use of this primary inlet 102, fluid 12 can be delivered through the primary inlet 102 and into the circumferential fluid portion 256. This circumferential fluid portion 256 is coupled with a secondary channel 258 that extends in a transverse direction from the circumferential fluid portion 256 and toward the shaft inlet 248 that extends through the drive shaft 42. Accordingly, when fluid 12 is to be delivered to the various lifters 22, fluid 12 is delivered to the primary inlet 102 and into the circumferential fluid portion 256. The fluid 12 in the circumferential fluid portion 256 is then directed toward the secondary channel 258, which forms a transverse inlet, that directs the fluid 12 into the shaft inlet 248 for delivery and dispersement by the manifold 250 positioned at the end of the drive shaft 42. The primary inlet 102 and secondary channels 258 are each positioned generally perpendicular to the axial fluid path of the shaft inlet 248.

Figure 28:
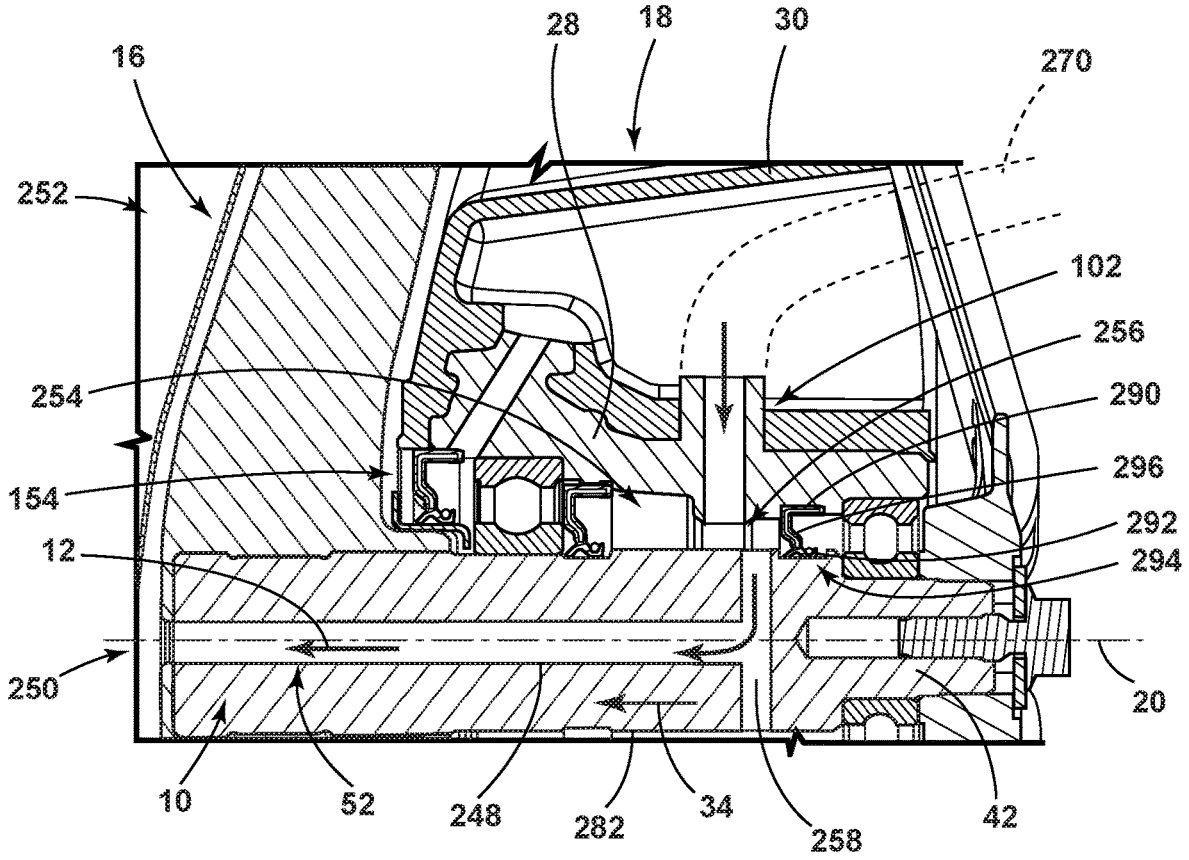
FIG. 28 is a schematic cross-sectional view of the laundry appliance of FIG. 27 and showing movement of water through the fluid delivery path.
Figure 28A:
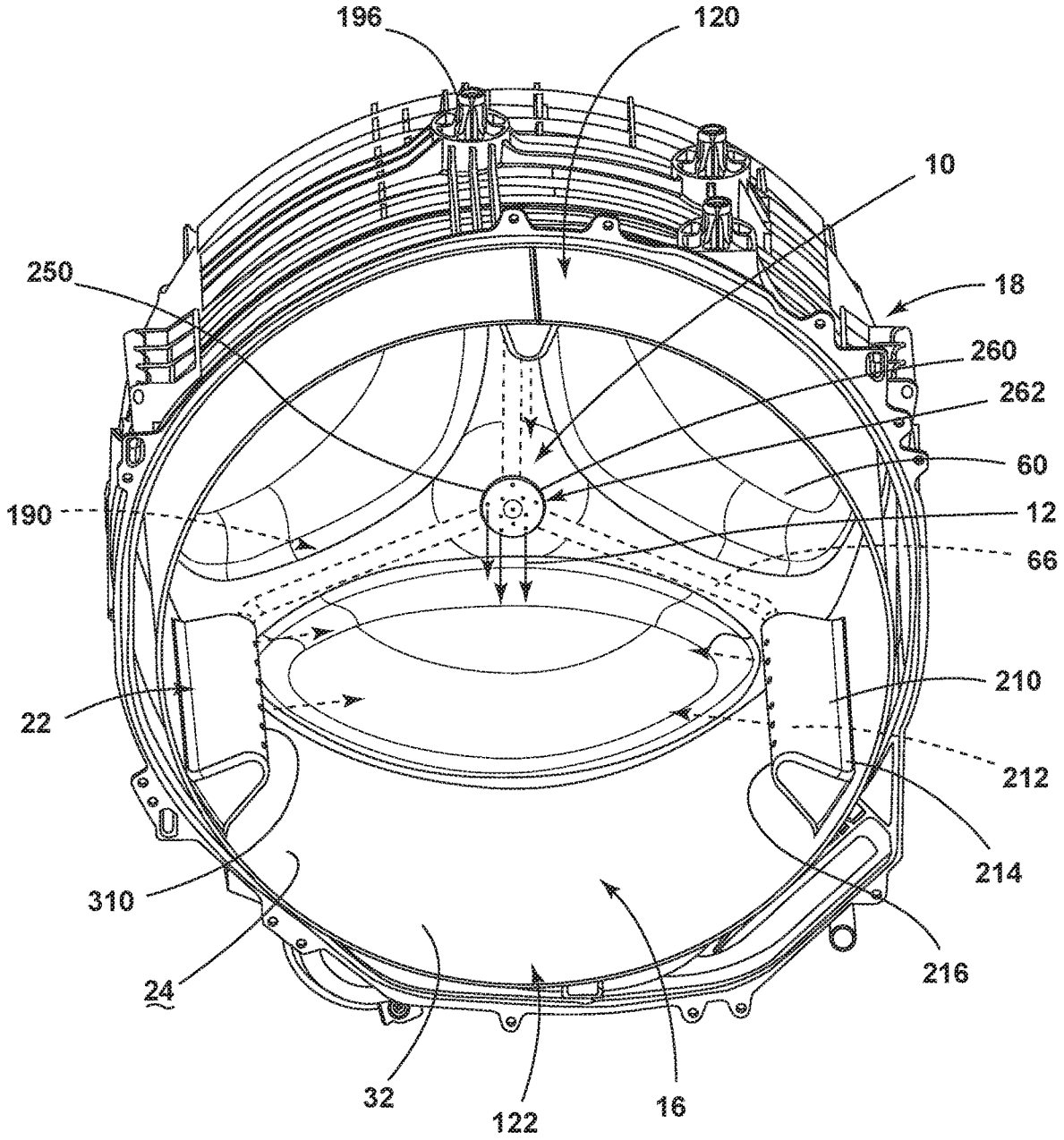
FIG. 28A is a front perspective view of an aspect of the fluid delivery path for delivering fluid to lifters of the drum via a spray module within a manifold.
Figure 28B:
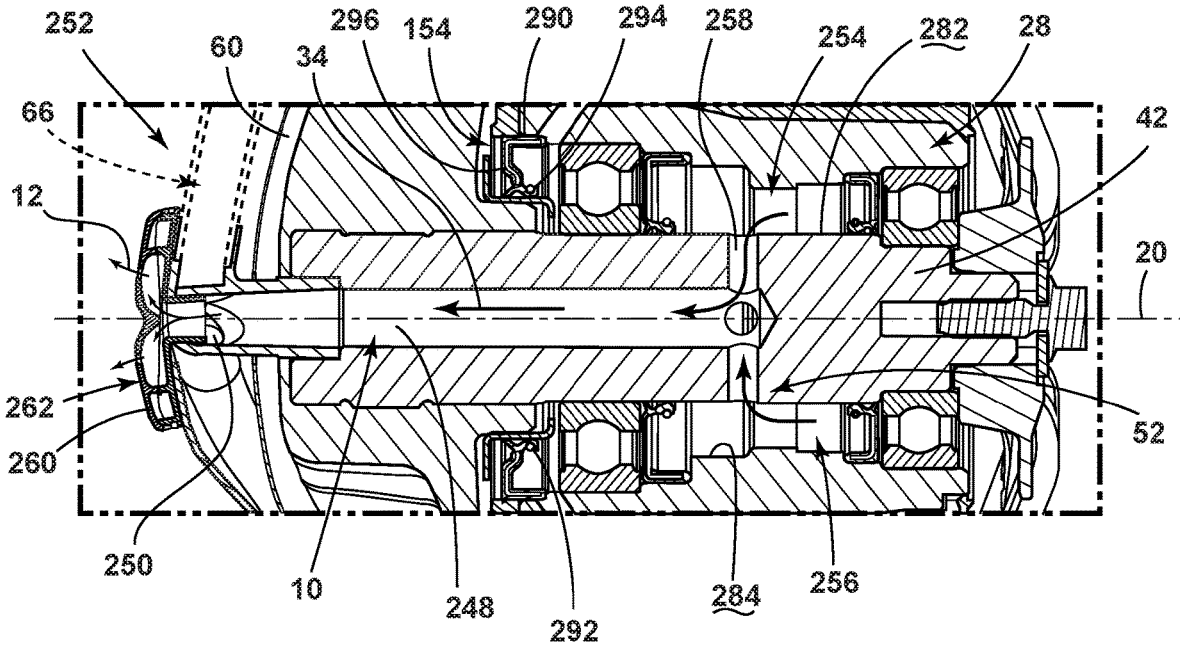
FIG. 28B is a schematic cross sectional view of an aspect of the spray module of the manifold.

In certain aspects of the device, as exemplified in FIGS. 28-28B, the manifold 250 can direct the fluid 12 in an axial direction 34 into the drum 16. In such an aspect, the manifold 250 can be positioned at the end of the drive shaft 42 and the manifold 250 can include a spray module 260 having a fluid spray configuration 262. This fluid spray configuration 262 allows the fluid 12 to extend through the shaft inlet 248, through the spray module 260 and directly out the fluid spray configuration 262 of the manifold 250. The spray module 260 and the fluid spray configuration 262 can be utilized as the primary path for the fluid 12. It is also contemplated that this fluid spray configuration 262 of the manifold 250 can be combined with the fluid conduits 66 and one or more sprayers within the lifters 22.

As exemplified in FIGS. 26-31, the primary inlet 102 can include a single inlet that engages with an inlet conduit 270 from a fluid pump 272. This primary inlet 102 then provides fluid 12 to the circumferential fluid portion 256. The secondary channel 258 can include a plurality of secondary channels 258 that extend from the circumferential fluid portion 256 and toward the shaft inlet 248. Through this configuration, fluid 12 can be delivered to the manifold 250 and outward to the lifters 22 in a direction parallel with the rotational axis 20 of the drive shaft 42 and the drum 16.

Referring again to FIGS. 26-31, the bearings 158 that extend between the drive shaft 42 and the hub 28 can include bearing seals 154 that serve to at least partially define the circumferential fluid space that extends between the drive shaft 42 and the structural hub 28. The primary inlet 102 and secondary channels 258 are each positioned between these bearing seals 154. Accordingly, the circumferential fluid portion 256 is contained between forward and rearward bearing seals 154 and between the outer surface 282 of the drive shaft 42 and the interior surface 284 of the structural hub 28. The bearing seals 154 serve to contain the fluid 12 within the circumferential fluid portion 256 so that sufficient fluid back pressure 52 can be utilized for moving the fluid 12 through the circumferential fluid portion 256, through the shaft inlet 248, the manifold 250, the fluid conduits 66 and ultimately through the lifters 22 and into the drum 16.

Figure 29:
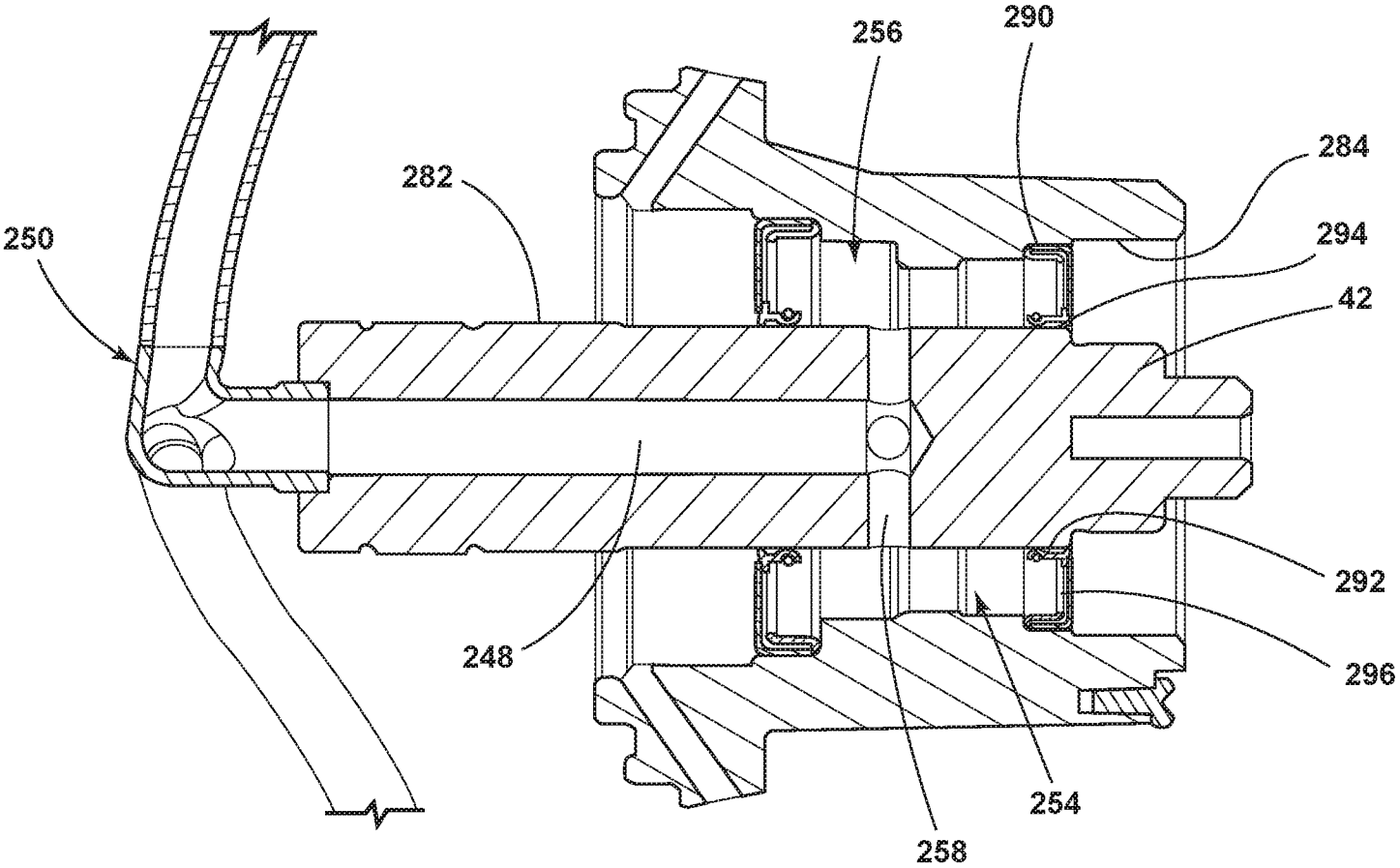
FIG. 29 is a schematic cross-sectional view showing components of the fluid delivery path for moving fluid axially through the drive shaft of the drum.
Figure 30:
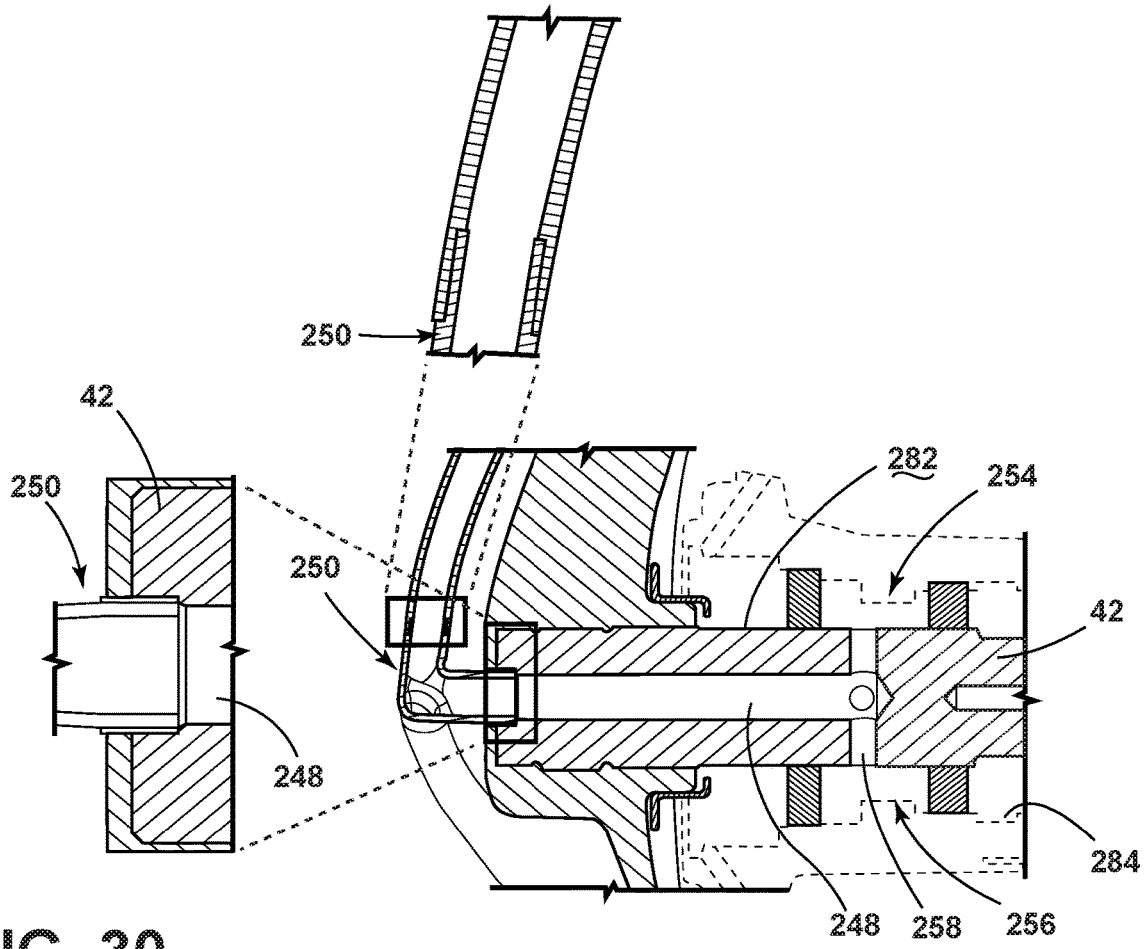
FIG. 30 is a schematic cross-sectional view of the fluid delivery path of FIG. 29.
Figure 31:
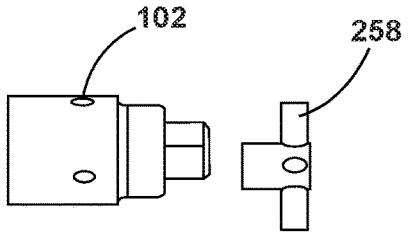
FIG. 31 is an enlarged cross-sectional view of the apertures positioned within the drive shaft for allowing movement of fluid therethrough.
Figure 32:
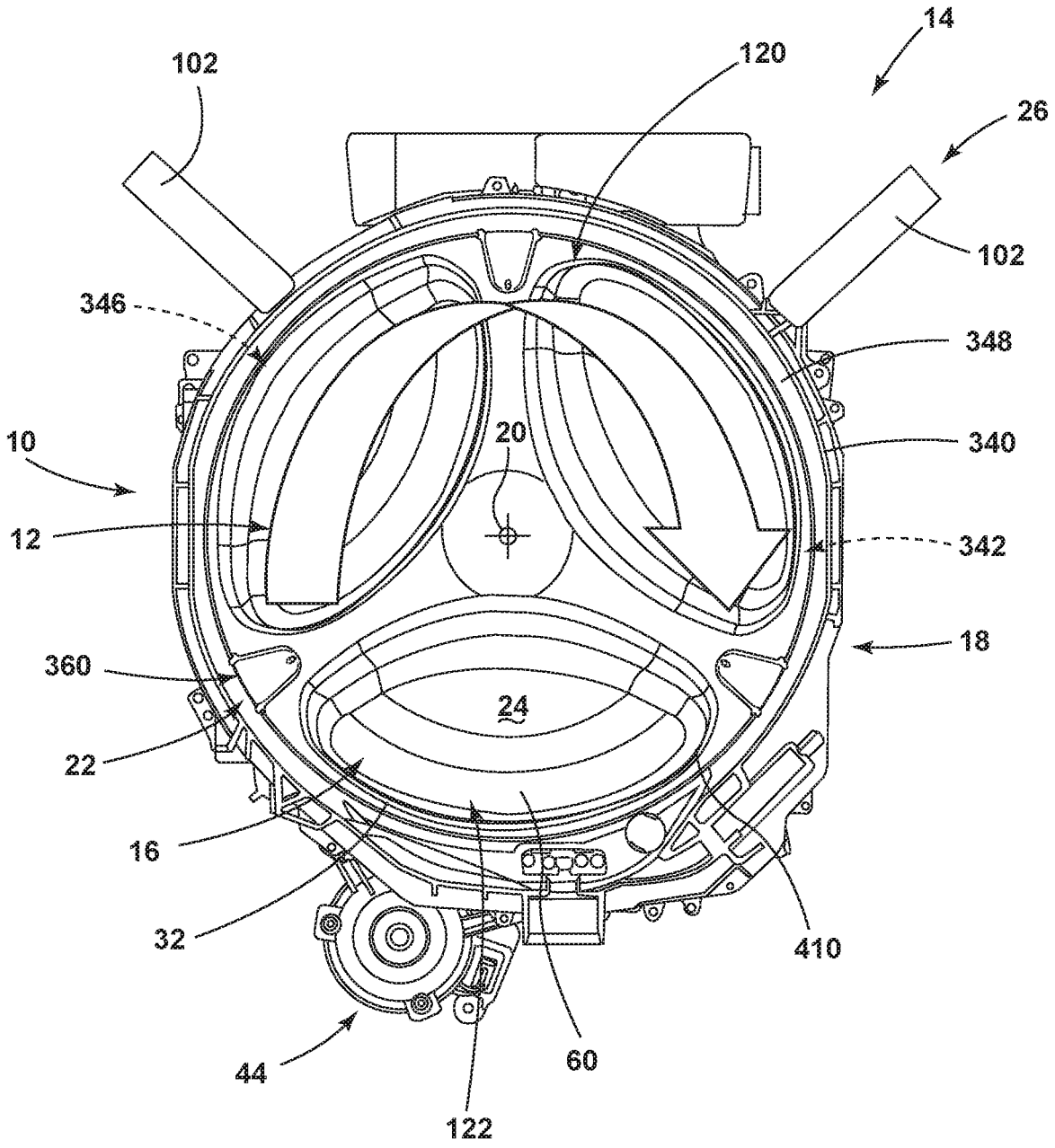
FIG. 32 is a front perspective view of an aspect of a fluid delivery path that incorporates a centrifugal delivery system.
Figure 33:
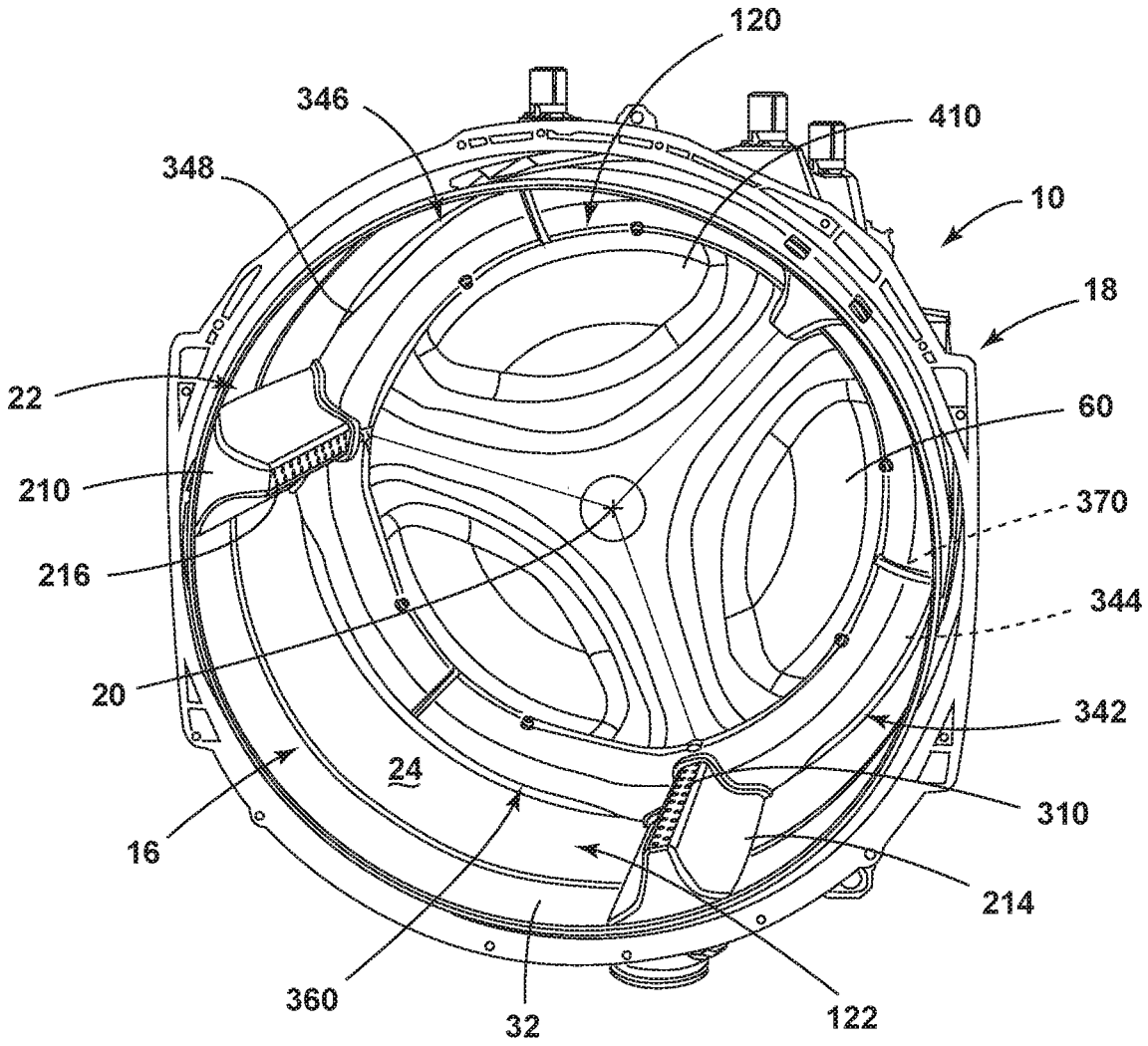
FIG. 33 is a front perspective view of the centrifugal fluid delivery system.
Figure 34:
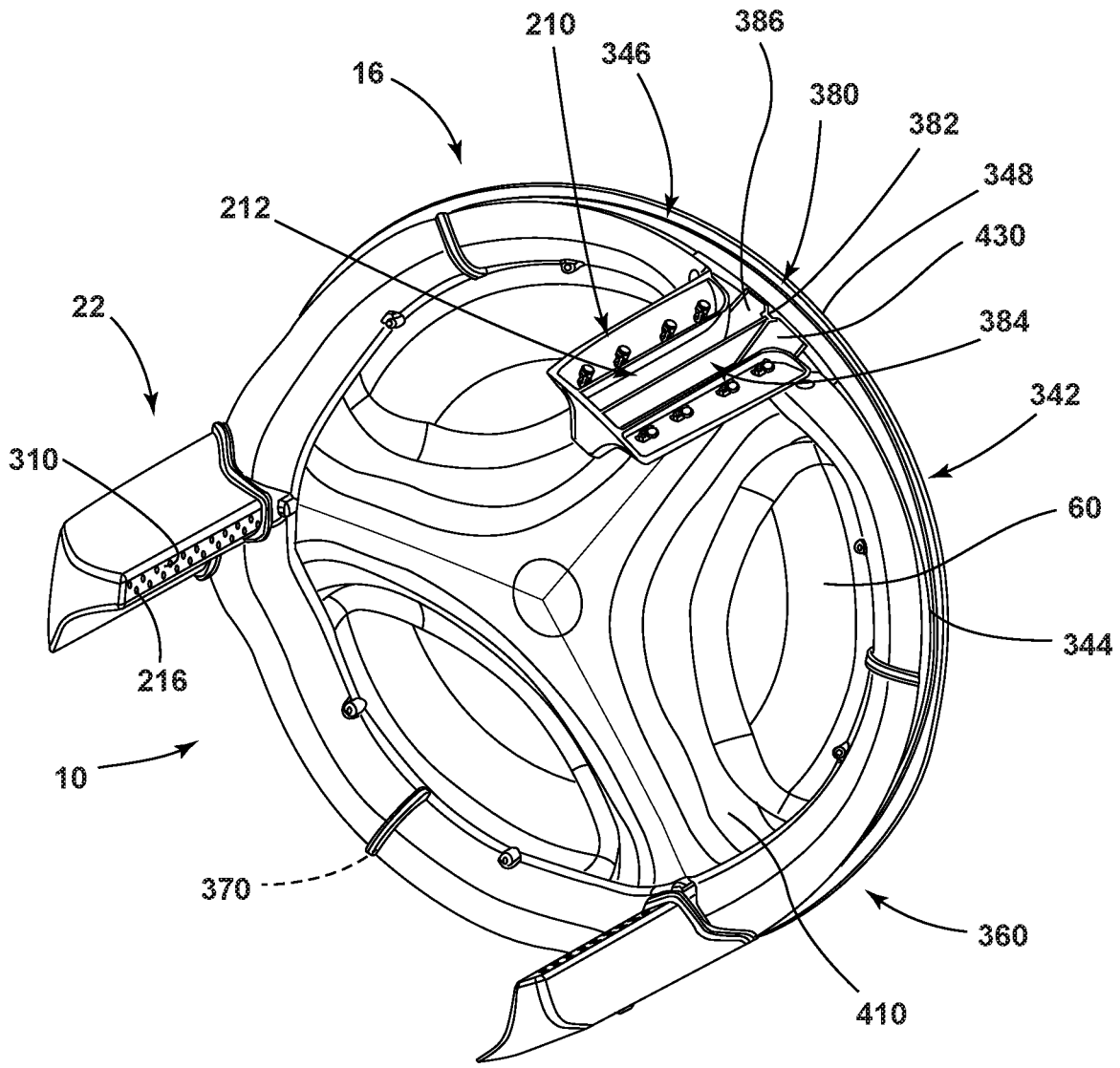
FIG. 34 is a side perspective view of the centrifugal fluid delivery system of FIG. 33 with a sidewall of the drum removed.

As exemplified in FIGS. 29-31, it is contemplated that the overall diameter of the fluid delivery path 10 between the primary inlet 102 and the lifters 22 can continually decrease or substantially decrease along the fluid delivery path 10. By way of example, and not limitation, the overall combined interior diameter of the secondary channel 258 can be greater than the interior diameter of the shaft inlet 248. This interior diameter can, in turn, be greater than the interior diameter of the inlets for the manifold 250. Each of the fluid conduits 66 can have a still smaller interior diameter. The interior diameter of the various apertures within the lifters 22 for providing the fluid 12 into the drum 16 can be smaller still. Accordingly, the back pressure 52 of the fluid 12 can be maintained through manipulation of the various interior diameters of the portions of the fluid delivery path 10 that move through the laundry appliance 14.

As exemplified in FIG. 29, the bearing seals 154 that are used to define the circumferential fluid portion 256 can include a generally U-shaped configuration. Additionally, these bearing seals 154 can include an outer seal 290 that can seat within a portion of the structural hub 28. In this manner, the hub-side portion of the bearing seals 154 can remain stationary with respect to the structural hub 28. The interior seals 292 of the bearing seals 154 can be configured to slidably engage the outer surface 282 of the drive shaft 42. Accordingly, the interior seal 292 of the bearing seals 154 include a sliding portion 294 that allows for slidable operation of the drive shaft 42 within the bearing seals 154. This slidable operation simultaneously provides for a sealing engagement between the bearing seals 154 to minimize the leakage 172 of fluid 12 from the circumferential fluid portion 256. To maintain the shape of these bearing seals 154, each bearing seal 154 can include a structural interior 296 that may have an L-shaped configuration or a U-shaped configuration that maintains the general shape of the bearing seal 154 while also providing for a slidable sealing engagement at the outer surface 282 of the drive shaft 42.

Figure 30A:
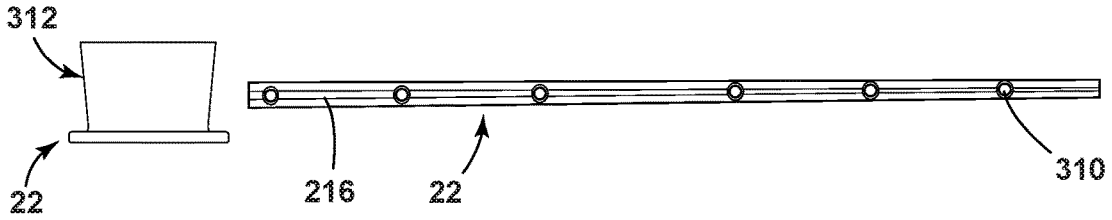
FIG. 30A is a schematic view of the lifter apertures positioned within each of the lifters.

According to various aspects of the device, as exemplified in FIG. 30A, the plurality of lifter apertures 310 at each of the lifters 22 can include various configurations. These lifter apertures 310 can include a tapered configuration where the diameter of the lifter aperture 310 inside of the lifter 22 may be smaller than the aperture of the lifter aperture 310 at the outside surface of the lifter 22. Accordingly, these tapered apertures 312 can produce a generally radial spray or non-concentrated spray that can direct fluid 12 in a variety of directions away from the lifter 22. The lifter apertures 310 can also include a narrowing geometry that provides for a more concentrated flow of fluid 12 through the lifter 22 into the drum 16. Lifter apertures 310 having a consistent diameter are also contemplated. The various apertures within the lifters 22, the manifold 250, the primary inlet 102 and secondary inlet can include various geometries as well. These geometries can include round, oval, polygonal, elongated, and other similar configurations. The exact design of the various openings and engagements between components of the fluid delivery path 10 can vary depending upon the configuration of the appliance.

As exemplified in FIGS. 26-31, the manifold 250 that is positioned at the end of the drive shaft 42 can couple with the various fluid conduits 66 that extend through the lifters 22. In this embodiment, the fluid conduits 66 can be at least partially incorporated within a cross piece 190 of the drum 16 or a back wall 60 of the drum 16. Alternatively, the fluid conduits 66 can be a separate member that is coupled with the manifold 250 to extend as an independent piece toward the various lifters 22. Typically, some covering or structural reinforcement will be provided for each of the fluid conduits 66 for protecting the fluid conduits 66 during rotation of the drum 16 and cross piece 190 during operation of the various laundry cycles.

Referring now to FIGS. 1, 2 and 32-44, according to various aspects of the device, the front-load laundry appliance 14 can include the drum 16 that is rotationally operable within the tub 18. The lifters 22 are disposed on the interior surface 284 of the drum 16 and fluid 12 is delivered to the drum 16 via the lifters 22. The lifters 22 are attached to a cylindrical wall 32 of the drum 16. Fluid 12 is delivered to the lifters 22 through a primary inlet 102 that extends through the tub 18 and in an axial direction 34 that is substantially parallel with a drive shaft 42 and the rotational axis 20 of the drum 16. The primary inlet 102 can be positioned near an outer circumference 340 of the tub 18 and extends to a perimeter fluid channel 342 of the drum 16. The lifters 22 extend from the perimeter fluid channel 342 and define an interior fluid space 344 through which the fluid 12 is moved to the lifters 22 for delivery into the drum 16. Fluid 12 is typically delivered to the perimeter fluid channel 342 as the drum 16 is rotated about the rotational axis 20.

As exemplified in FIGS. 32-36, the primary inlet 102 extends through the rear wall 30 of the tub 18 and is positioned adjacent to a portion of the perimeter fluid channel 342. This peripheral fluid space 346 of the perimeter fluid channel 342 typically defines an outer periphery 348 of the back wall 60 of the drum 16. As fluid 12 moves through the primary inlet 102, fluid 12 is filled within a portion of the peripheral fluid space 346. This fluid 12 is then directed according to the force of gravity as well as the centrifugal force generated by rotation of the drum 16 toward the lifters 22. As the drum 16 rotates about the rotational axis 20, fluid 12 is delivered, by centrifugal force and gravity, through the lifter apertures 310 that are defined within the various lifters 22 within the laundry appliance 14.

As exemplified in FIGS. 32-38, the perimeter fluid channel 342 and the lifters 22 can be divided into a plurality of separate interior perimeter spaces 360. As exemplified in the figures described above, three separate interior perimeter spaces 360 are defined within the perimeter fluid channel 342. It is contemplated that each interior perimeter space 360 extends from the perimeter fluid channel 342 into a respective lifter 22. Rotation of the drum 16 serves to sequentially place each separate interior perimeter space 360 in alignment and fluid communication with the primary inlet 102. Accordingly, as the drum 16 rotates, different portions of the perimeter fluid channel 342 are positioned to receive fluid 12 from the primary inlet 102. As the drum 16 rotates, each separate interior perimeter space 360 sequentially receives fluid 12 from the primary inlet 102 and can direct this fluid 12 toward and through the lifter apertures 310 defined within each lifter 22.

Figure 35:
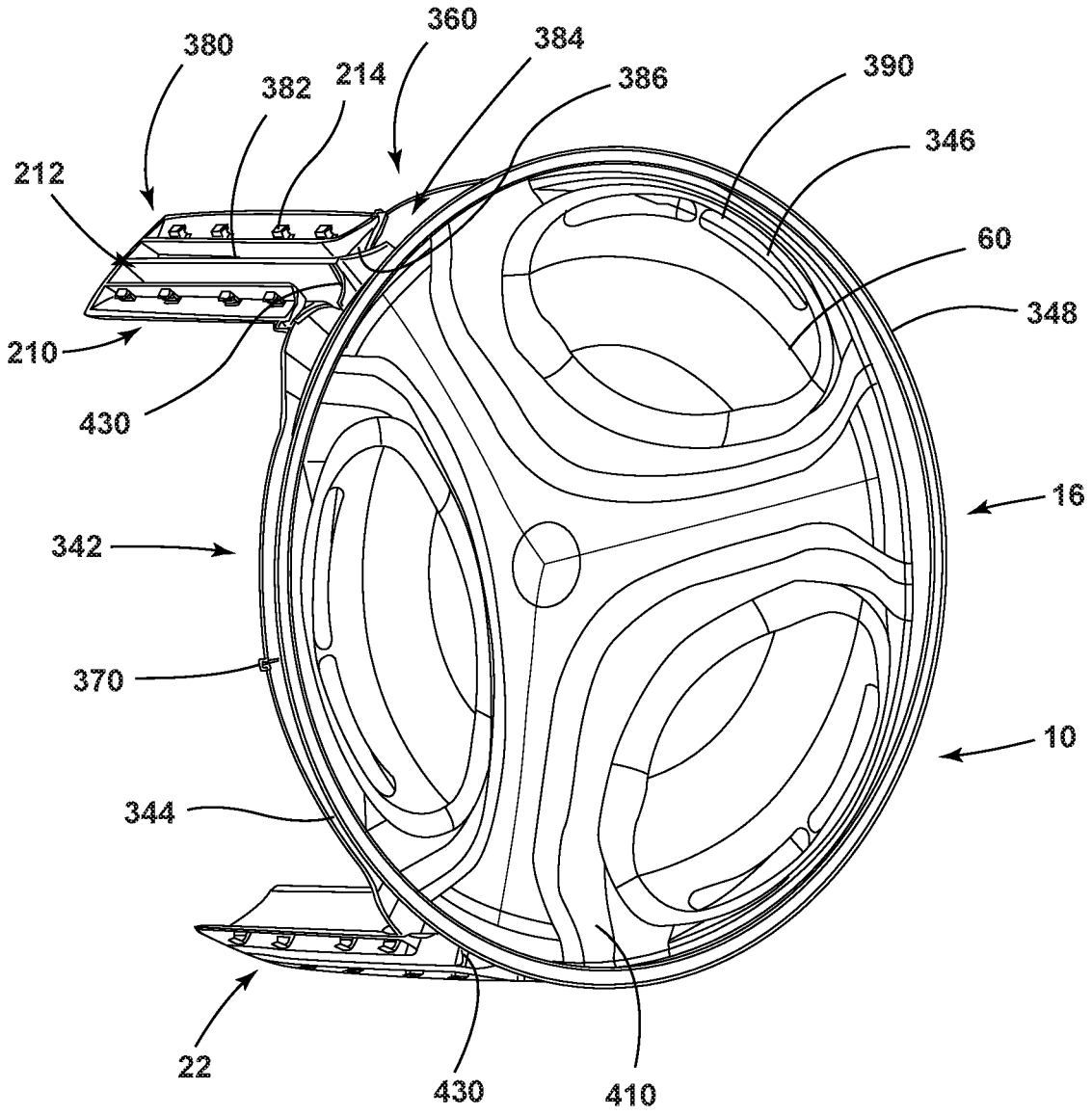
FIG. 35 is a rear perspective view of the centrifugal fluid delivery system of FIG. 34.
Figure 38:
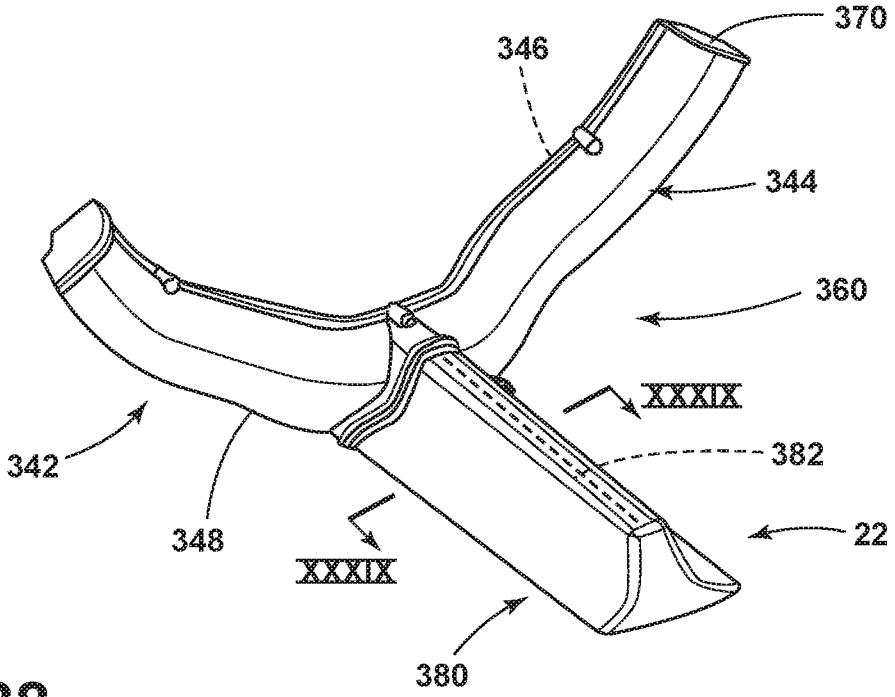
FIG. 38 is a side perspective view of a module of the centrifugal fluid delivery system that is positioned within a drum for the laundry appliance.
Figure 39:
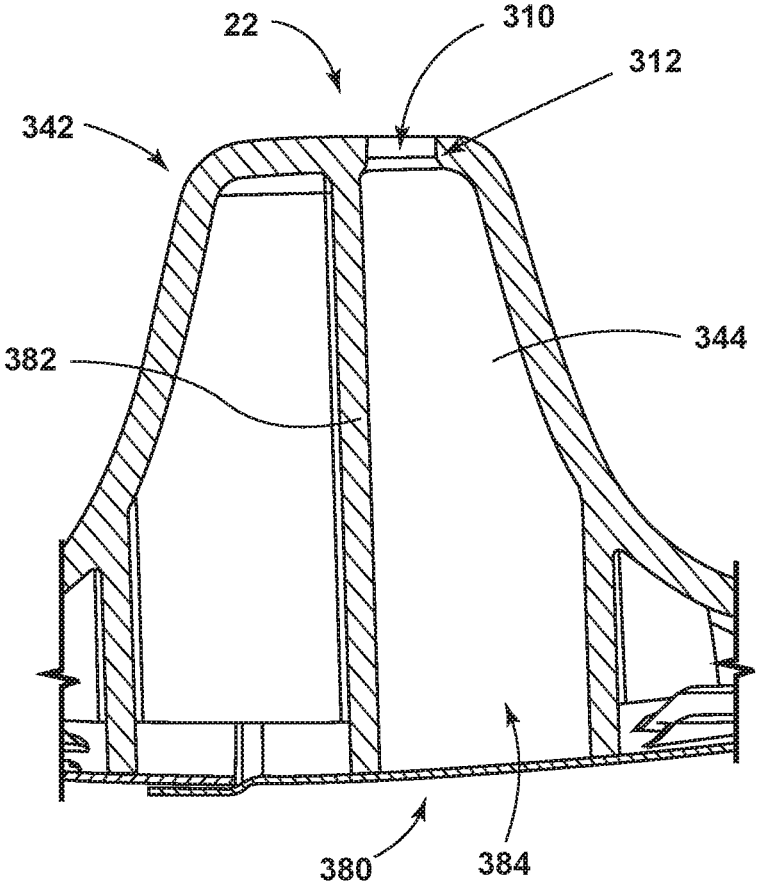
FIG. 39 is a cross-sectional view of a lifter used in connection with the centrifugal fluid delivery system of FIG. 38 taken along line XXXIX-XXXIX.

As exemplified in FIGS. 35 and 38, the perimeter fluid channel 342 is divided into the separate interior perimeter spaces 360 via interior partitions 370. These interior partitions 370 prevent the movement of fluid 12 between the separate interior perimeter spaces 360. These partitions 370 also help to direct the fluid 12 through the lifters 22. As each separate interior perimeter space 360 is placed into alignment with the primary inlet 102, fluid 12 is disposed within each interior perimeter space 360 and substantially fills each interior perimeter space 360. As the drum 16 rotates, the force of gravity and the centrifugal forces will direct this fluid 12 toward the lifters 22. Typically, the primary inlet 102 is positioned at a top portion 120 of the tub 18. As each interior perimeter space 360 is aligned with the primary inlet 102 at the top of the tub 18, the interior perimeter space 360 is filled with fluid 12. As the interior perimeter space 360 is rotated around the rotational axis 20, the filled interior perimeter space 360 is rotated downward. During this rotation, a significant portion of fluid 12 may be projected out of the lifter apertures 310, primarily through gravitational force. Similarly, as the lifter 22 rotates upward and around the rotational axis 20, additional amounts of fluid 12 may be projected out of the lifter apertures 310 as the drum 16 rotates about the rotational axis 20. This sequential operation happens with each separate interior perimeter space 360 as the drum 16 rotates about the rotational axis 20.

As exemplified in FIG. 35, each interior perimeter space 360 of the perimeter fluid channel 342 can be further subdivided into opposing sections 380 of each interior perimeter space 360. These opposing sections 380 can be divided within each respective lifter 22 by a dividing wall 382 that extends through an interior portion 384 of the lifter 22. These interior dividing walls 382 can also include flow directing features 386 that can be used to promote a flow of fluid 12 toward the lifters 22 and the lifter apertures 310. Accordingly, through the use of the interior partitions 370 and the dividing walls 382, the perimeter fluid channel 342 can be subdivided into six separate portions that can each be sequentially aligned with the fluid inlet 148. It should be understood that additional portions can be included based upon the number of lifters 22 within the drum 16.

It is contemplated that a primary inlet 102 can be positioned at a top portion 120 of the tub 18, a bottom portion 122 of the tub 18 or other similar portion of the tub 18. In each of these positions, fluid 12 can be disposed within the perimeter fluid channel 342 and will be substantially expressed therefrom during rotation of the drum 16 about the rotational axis 20. Accordingly, the force of gravity and the centrifugal force produced by operation of the drum 16 may result in an expression of most of the fluid 12 from the perimeter fluid channel 342.

Figure 36:
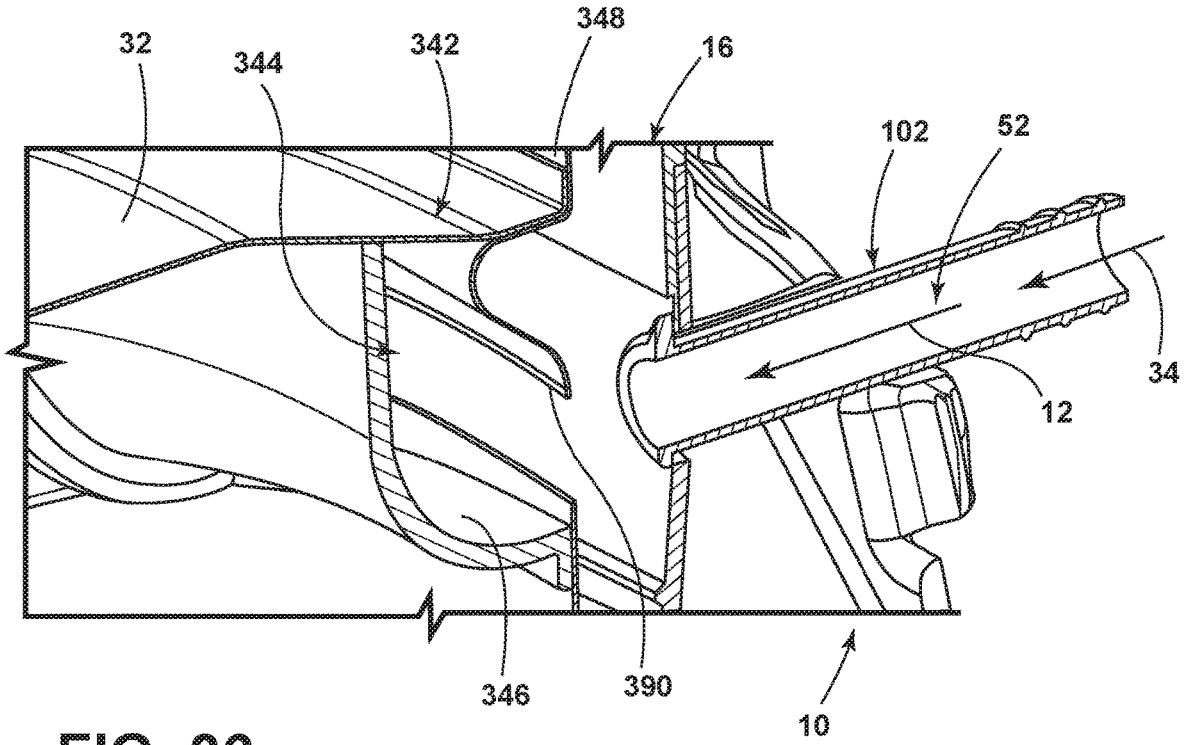
FIG. 36 is a cross-sectional view of the fluid inlet for delivering fluid to the centrifugal fluid delivery system.
Figure 37:
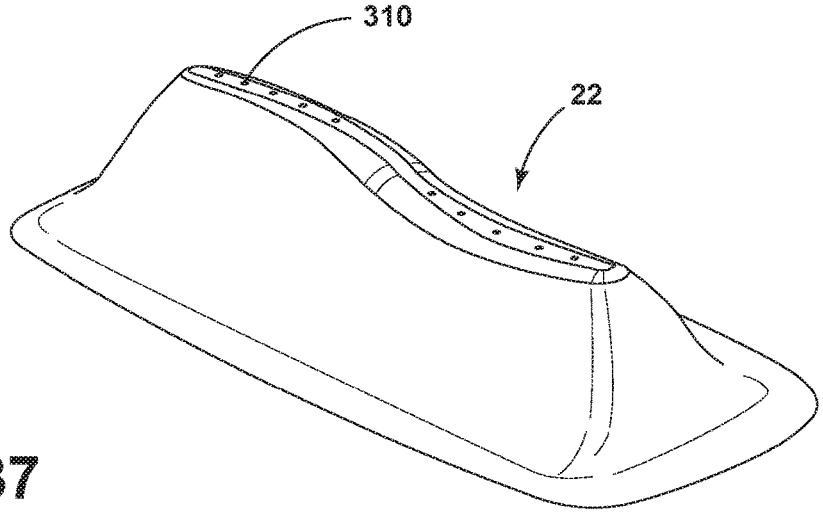
FIG. 37 is a perspective view of a lifter for the fluid delivery system.

As exemplified in FIGS. 35 and 36, the back wall 60 of the drum 16 can include a plurality of inlet slots 390 that substantially align with the primary inlet 102. As these inlet slots 390 align with the primary inlet 102, fluid 12 from the primary inlet 102 is projected into the perimeter fluid channel 342. These inlet slots 390 can also be used to allow for the drainage of excess fluid 12 that may not be moved through the lifter apertures 310 during operation of the drum 16 about the rotational axis 20.

As exemplified in FIGS. 38-44, the interior cross-sectional dimensions of the perimeter fluid channel 342 can vary between the interior partition 370 and the lifters 22. As exemplified in FIG. 39, a cross section of the lifter 22 can be a substantially consistent cross section along the entire length of the lifter 22. Alternatively, the perimeter fluid channel 342 may have a varying cross section that can promote a flow of fluid 12 from various portions of the perimeter fluid channel 342 and into the lifter 22. The perimeter fluid channel 342 can include an undulating wall 410 that provides an enlarged volume 412 of the perimeter fluid channel 342 near the partition and a diminished volume 414 of the perimeter fluid channel 342 near the lifter 22. This configuration allows for a collection of fluid 12 within an enlarged volume 412 and within the lifter 22. The undulating wall 410 of the drum 16 can be used to diminish the volume and assist in biasing the fluid 12 toward the lifter 22 as the drum 16 rotates about the rotational axis 20.

Figure 40:
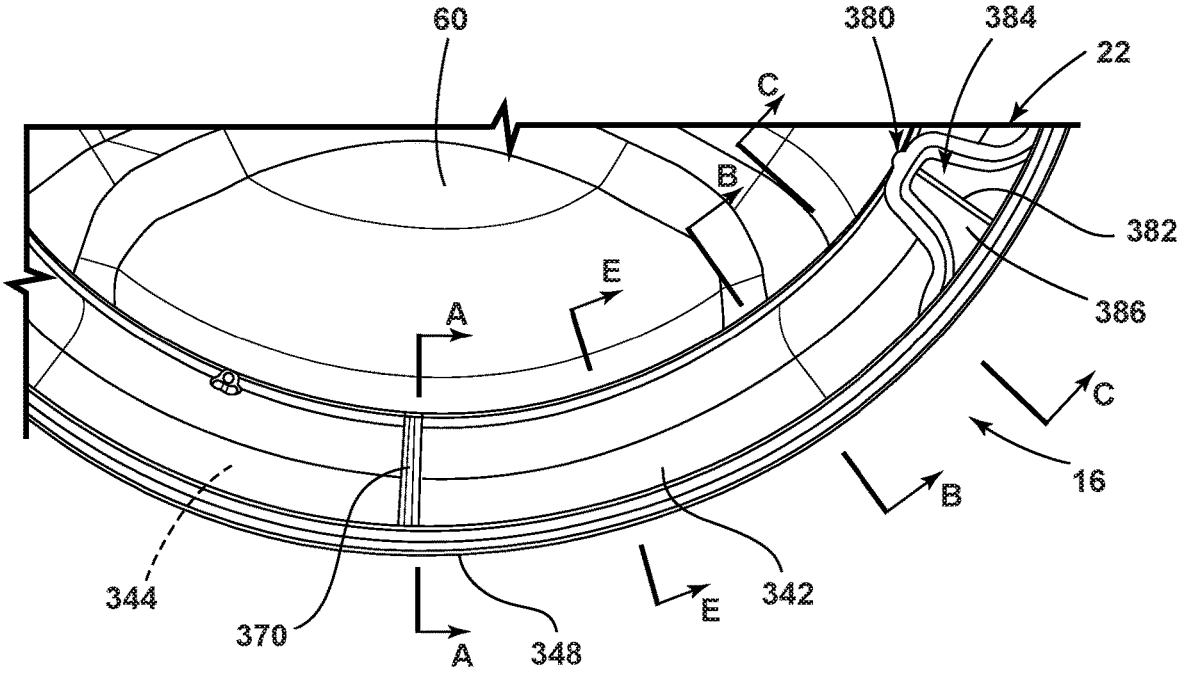
FIG. 40 is a partial elevational view of the centrifugal fluid delivery system for a laundry appliance.
Figure 41:
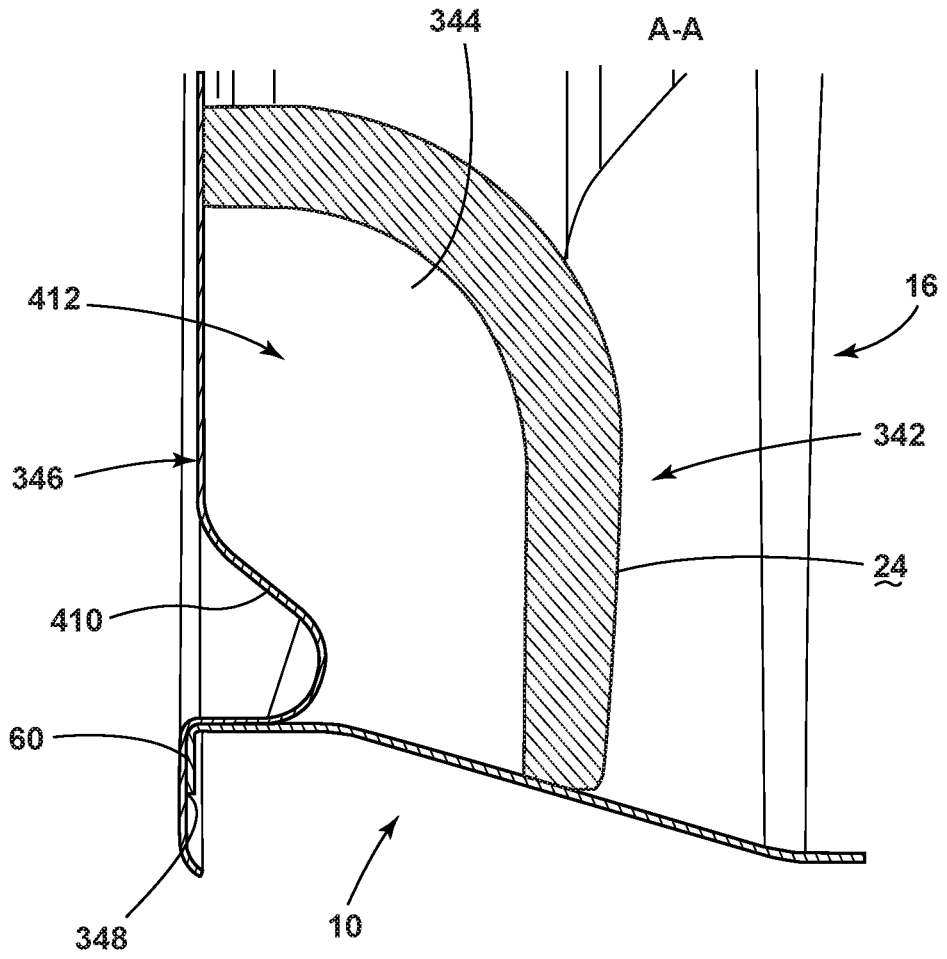
FIG. 41 is a cross-sectional view of the laundry appliance of FIG. 40 taken along line A-A.
Figure 42:
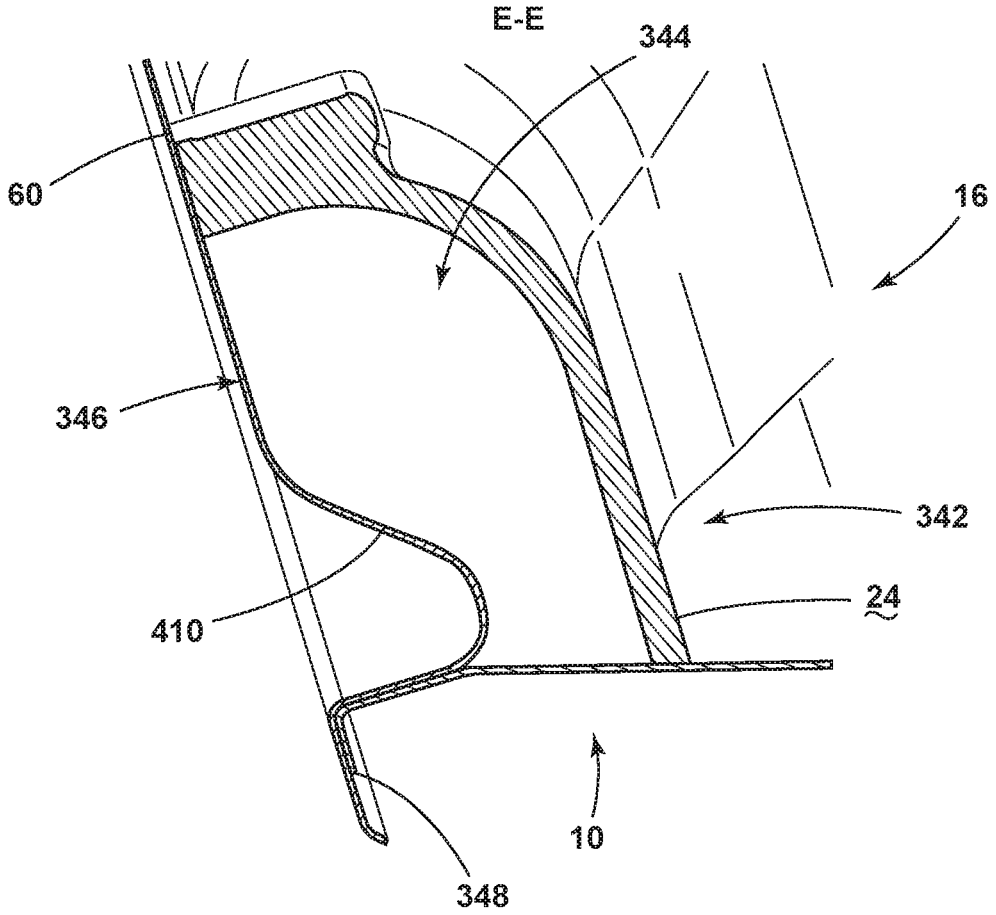
FIG. 42 is a cross-sectional view of the laundry appliance of FIG. 40 taken along line E-E.
Figure 43:
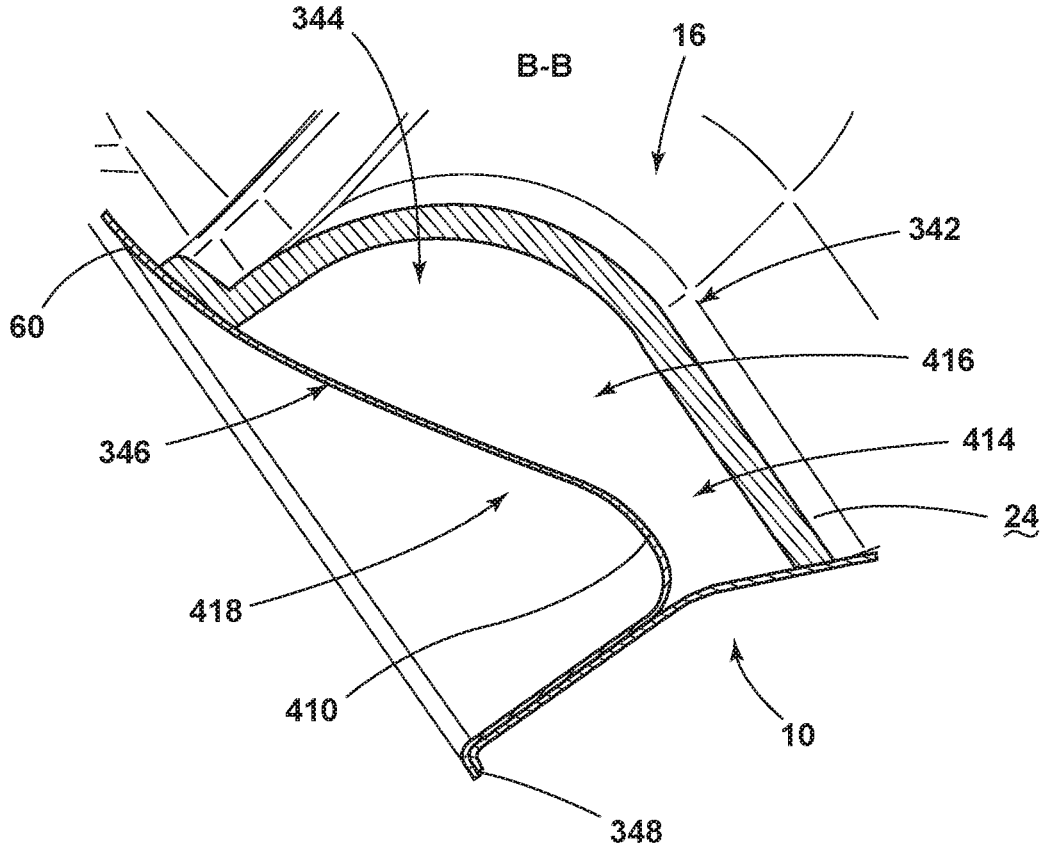
FIG. 43 is a cross-sectional view of the laundry appliance of FIG. 40 taken along line V-V.
Figure 44:
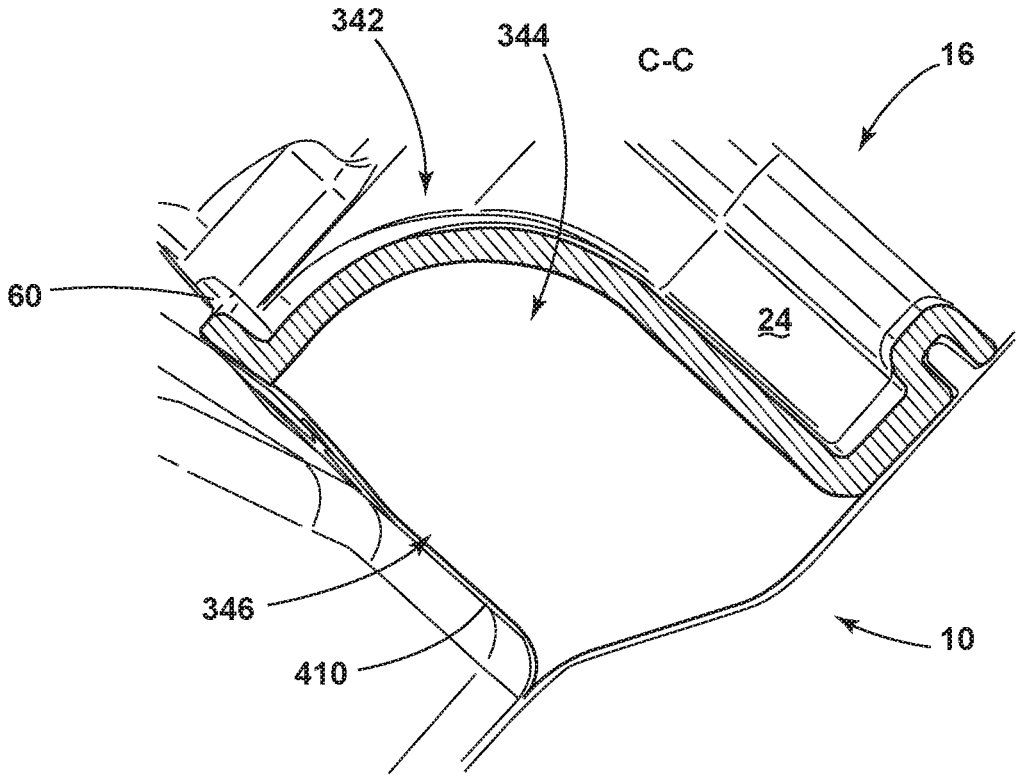
FIG. 44 is a cross-sectional view of the laundry appliance of FIG. 40, taken along line C-C.

By way of example, and not limitation, between cross-sectional lines AA and BB, as shown in FIG. 40, the cross-sectional area of the perimeter fluid channel 342 may decrease between the partition and toward the lifter 22. This taper within the volume of the perimeter fluid channel 342 can allow for a space within which fluid 12 can be deposited from the primary inlet 102. The elongated inlet slot 390 within the back wall 60 of the drum 16 can be aligned with this enlarged volume 412 of the perimeter fluid channel 342. As the drum 16 rotates about the rotational axis 20, fluid 12 can be funneled through the narrowed portion 416 within the perimeter fluid channel 342 in the area of cross-sectional line B-B. As shown in FIG. 44, the cross-sectional area at the lifter 22 enlarges again to receive the fluid 12 from the enlarged volume 412 and this fluid 12 can be directed toward the lifter 22 and the lifter apertures 310. The narrowed portion 416 at line B-B also provides a containment feature 418 that at least partially limits the movement of fluid 12 out from the lifter 22 and back into the enlarged volume 412 within the perimeter fluid channel 342. Through this configuration, rotation of the drum 16 about the rotational axis 20 can serve to produce forces that can deliver fluid 12 into the drum 16 via the lifter 22 and lifter apertures 310. Accordingly, the shape of the perimeter fluid channel 342 can promote this directing of fluid 12 through the lifter apertures 310 and into the drum 16. The undulating wall 410 of the perimeter fluid channel 342 can be defined by a portion of the back wall 60 of the drum 16 or can be defined by a separate offset portion within the back wall 60 of the drum 16.

The dividing wall 382 within each of the lifters 22 can include the flow directing features 386 that can be defined by curved portions 430 of the dividing wall 382. These curved portions 430 can be used to provide a substantially laminar flow of the fluid 12 from the perimeter fluid channel 342 and into the lifters 22. This laminar flow can provide for a more efficient flow of fluid 12 into the lifters 22 and through the lifter apertures 310.

According to various aspects of the device, the various components of the fluid delivery path 10 described herein can be incorporated within various appliances. These appliances can include, but are not limited to, washers, dryers, combination washers and dryers, and other similar appliances. These configurations can also be used within horizontal axis laundry appliances 14 or angled axis laundry appliances 14. Through the use of these configurations, fluid 12 can be delivered into the drum 16 without substantially adding to the number of perforations through the tub 18 for the laundry appliance 14. Additional perforations within the tub 18 are typically locations that need to be sealed to prevent leaking from the laundry appliance 14. By minimizing the number of these perforations through the tub 18, additional sealing may not be necessary. Also, by delivering fluid 12 through an area defined at the drive shaft 42 or near the drive shaft 42, a pre-existing aperture or perforation is already included and additional sealing mechanisms may not be necessary for providing fluid 12 into the tub 18 and into the drum 16. Additionally, by incorporating the primary inlets 102 within existing structures such as the structural hub 28, areas between the drive shaft 42 and the hub 28 and other similar locations, these additional sealing locations can be eliminated or at least minimized.

According to various aspects of the device, the flow of fluid 12 into the fluid delivery path 10 is typically generated by a fluid pump 272 that directs the fluid 12 into the fluid delivery path 10 and in an axial direction 34 substantially parallel with the rotational axis 20 of the drive shaft 42 and the drum 16. The type of fluid 12 that is delivered into the tub 18 and drum 16 can vary between different appliances and between different laundry cycles. By way of example, and not limitation, the fluid 12 delivered into the fluid delivery path 10 can include fresh water, recycled water that is previously used within a laundry cycle, rinse water, water containing various detergent and other chemistries, and other similar sources of water both internal and external to the laundry appliance 14.

According to various aspects of the device, fluid 12 delivered to the fluid delivery path 10 can be from a primary pump, in combination with various diverter valves that are used to divert a flow of fluid 12 to various locations within the laundry appliance 14. Additionally, where multiple primary inlets 102 are used, a diverter valve can be utilized for changing the entry point of fluid 12 to a different location or multiple locations within the fluid delivery path 10.

According to another aspect of the present disclosure, a front-load laundry appliance includes a drum that is rotationally operable within a tub about a generally horizontal rotational axis. A plurality of lifters are coupled to an interior surface of the drum. A fluid delivery path is at least partially defined within the drum and the plurality of lifters. A fluid delivery system delivers fluid into the fluid delivery path in a direction parallel to the generally horizontal rotational axis.

According to another aspect, the front-load laundry appliance further includes a fluid delivery ring that is defined between the tub and the drum. The fluid delivery ring is concentric to a drive shaft of the drum. An interior gasket is operably positioned within the fluid delivery ring, wherein the interior gasket selectively operates to define a fluid channel within the fluid delivery ring.

According to yet another aspect, the interior gasket is minimally engaged with the drum when no fluid is delivered to the plurality of lifters. When fluid is delivered through the fluid delivery ring, back pressure of the fluid biases the interior gasket against the drum to define the fluid channel within the fluid delivery ring. Fluid is delivered through the fluid channel and to the plurality of lifters.

According to another aspect of the present disclosure, fluid is selectively delivered to the plurality of lifters at least when the drum is rotationally stationary relative to the tub.

According to another aspect, the interior gasket includes concentric lips that define the fluid channel when the fluid biases the interior gasket against the drum. The concentric lips are minimally engaged with the drum in the absence of the fluid.

According to yet another aspect, the interior gasket is fixed to a metallic hub of the tub, and the interior gasket slidably engages the drum.

According to another aspect of the present disclosure, the interior gasket includes a gasket membrane that includes gasket apertures. The back pressure of the fluid biases the gasket membrane toward the drum to define the fluid channel and contemporaneously directs the fluid through the gasket apertures and into the fluid channel.

According to another aspect, the front-load laundry appliance includes a structural hub of the tub. An outer portion of a hub includes a fluid inlet that extends to a fluid space concentrically defined between the tub and the drum. The front-load laundry appliance includes a concentric flange of the drum. The fluid space is near the drive shaft and is defined by the concentric flange that seals an outer portion of the fluid space.

According to yet another aspect, the concentric flange engages the hub at a concentric channel. The circumferential channel and the concentric flange define a labyrinth seal around the outer perimeter of the fluid space.

According to another aspect of the present disclosure, the plurality of lifters each include a lifter duct that extends from the fluid space and to each lifter, respectively.

According to another aspect, a front-load laundry appliance includes a drum that is rotationally operable within a tub. Lifters are disposed on an interior surface of the drum. Fluid is delivered to the drum via lifters that are attached to a wall of the drum. Fluid is delivered to the lifters through a fluid inlet that extends through the tub and in an axial direction parallel with a drive shaft and a rotational axis of the drum. A drive shaft is attached to the drum. The fluid inlet extends axially through the drive shaft to a manifold that apportions the fluid among the lifters of the drum. The front-load laundry appliance includes a plurality of bearings, wherein the fluid inlet includes a fluid space defined between the drive shaft, a hub of the tub and the plurality of bearings that rotationally couple the drive shaft to the tub.

According to yet another aspect, the plurality of bearings include seals that define the fluid space for delivering the fluid to the fluid inlet. A fluid conduit extends through the hub of the tub and to the fluid space.

According to another aspect of the present disclosure, the manifold is positioned at an end of the drive shaft and includes a three-way fitting that delivers fluid to the three lifters.

According to another aspect, the drive shaft includes at least one transverse inlet that extends between the fluid space around the drive shaft and the fluid inlet within the drive shaft.

According to yet another aspect, each lifter includes a structural portion that is attached to the drum and a fluid portion having a plurality of lifter apertures that direct the fluid into the drum.

According to another aspect of the present disclosure, the fluid portion receives the fluid from the manifold via an inlet conduit.

According to another aspect, a drum is rotationally operable within a tub. Lifters are disposed on an interior surface of the drum. Fluid is delivered to the drum via lifters that are attached to a wall of the drum. Fluid is delivered to the lifters through a fluid inlet that extends through the tub and in an axial direction parallel with a drive shaft and a rotational axis of the drum. The fluid inlet is positioned near an outer circumference of the tub and extends to a perimeter fluid channel of the drum. The lifters extend from the perimeter fluid channel to define an interior space through which the fluid is moved to the lifters. Fluid is delivered to the perimeter fluid channel as the drum is rotated.

According to yet another aspect, the perimeter fluid channel and the lifters are divided into three separate interior spaces. Each interior space extends from the perimeter fluid channel and to a respective lifter.

According to another aspect of the present disclosure, rotation of the drum sequentially places each separate interior space in alignment with the fluid inlet to apportion the fluid among the three separate interior spaces.

According to another aspect, each separate interior space is further divided into opposing sections, the opposing sections being divided at the respective lifter.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A front-load laundry appliance comprising:

a drum that is rotationally operable within a tub about a generally horizontal rotational axis;

a plurality of lifters coupled to an interior surface of the drum;

a fluid delivery path at least partially defined within the drum and the plurality of lifters;

a fluid delivery system that delivers fluid into the fluid delivery path in a direction parallel to the generally horizontal rotational axis, wherein at least a portion of the fluid is delivered through the plurality of lifters and into the drum;

a fluid delivery ring that is defined by the tub and the drum, the fluid delivery ring being concentric to a drive shaft of the drum; and an interior gasket operably positioned with the fluid delivery ring, wherein the interior gasket selectively operates to define a fluid channel that extends continuously within the fluid delivery ring.

2. The front-load laundry appliance of claim 1, wherein the interior gasket is minimally engaged with the drum when no fluid is delivered to the plurality of lifters, wherein when the fluid is delivered through the fluid delivery ring, back pressure of the fluid biases the interior gasket against the drum to define the fluid channel within the fluid delivery ring, and wherein the fluid is delivered through the fluid channel and to the plurality of lifters.

3. The front-load laundry appliance of claim 2, wherein fluid is selectively delivered to the plurality of lifters at least when the drum is rotationally stationary relative to the tub.

4. The front-load laundry appliance of claim 1, wherein the interior gasket includes concentric lips that define the fluid channel when the fluid biases the interior gasket against the drum, and where the concentric lips are minimally engaged with the drum in an absence of the fluid.

5. The front-load laundry appliance of claim 4, wherein the interior gasket is fixed to a metallic hub of the tub, and wherein the interior gasket slidably engages the drum.

6. The front-load laundry appliance of claim 2, wherein the interior gasket includes a gasket membrane that includes gasket apertures, wherein the back pressure of the fluid biases the gasket membrane toward the drum to define the fluid channel and contemporaneously directs the fluid through the gasket apertures and into the fluid channel.

7. The front-load laundry appliance of claim 1, further comprising:

a structural hub of the tub, wherein an outer portion of a hub includes a fluid inlet that extends to the fluid delivery ring concentrically defined between the tub and the drum; and a concentric flange of the drum, wherein a fluid space is near the drive shaft and is defined by the concentric flange that seals an outer portion of the fluid delivery ring.

8. The front-load laundry appliance of claim 7, wherein the concentric flange engages the hub at a concentric channel, where the concentric channel and the concentric flange define a labyrinth seal around an outer perimeter of the fluid space.

9. The front-load laundry appliance of claim 8, wherein the plurality of lifters each include a lifter duct that extends from the fluid space and to each lifter, respectively.

10. A front-load laundry appliance comprising:

a drum that is rotationally operable within a tub; and lifters that are disposed on an interior surface of the drum, wherein fluid is delivered to the drum via the lifters that are attached to a wall of the drum, wherein fluid is delivered to the lifters through a fluid inlet that extends through the tub and in an axial direction parallel with a drive shaft and a rotational axis of the drum, wherein the fluid inlet is positioned near an outer circumference of the tub and extends to a perimeter fluid channel of the drum, and wherein the lifters extend from the perimeter fluid channel to define an interior space through which the fluid is moved to the lifters, where fluid is delivered to the perimeter fluid channel as the drum is rotated.

11. The front-load laundry appliance of claim 10, wherein the perimeter fluid channel and the lifters are divided into three separate interior spaces, where each interior space extends from the perimeter fluid channel and to a respective lifter.

12. The front-load laundry appliance of claim 11, wherein rotation of the drum sequentially places each of the separate interior spaces are in alignment with the fluid inlet to apportion the fluid among the three separate interior spaces.

13. The front-load laundry appliance of claim 11, wherein each separate interior space is further divided into opposing sections, the opposing sections being divided at the respective lifter.

14. A front-load laundry appliance comprising:

a drum that is rotationally operable within a tub;

lifters that are disposed on an interior surface of the drum, wherein fluid is delivered into the drum via the lifters;

a fluid inlet that extends through the tub, wherein fluid is delivered to the lifters through a fluid inlet and in an axial direction parallel with a drive shaft;

a cross piece coupled with a back wall of the drum and that defines a concentric fluid space, wherein the fluid inlet extends through the tub and directs the fluid to the concentric fluid space, and wherein the concentric fluid space apportions the fluid among the lifters of the drum;

a bearing seal that extends between the drum and the tub, wherein the bearing seal at least partially encloses the concentric fluid space; and lifter ducts that extend from the concentric fluid space to the lifters, respectively.

15. The front-load laundry appliance of claim 14, wherein the cross piece includes a concentric flange that defines an outer boundary of the concentric fluid space, wherein the concentric flange of the cross piece cooperates with a concentric channel of the tub to define a labyrinth seal of the concentric fluid space.

16. The front-load laundry appliance of claim 15, wherein the labyrinth seal is a pressure regulator of the concentric fluid space, wherein a portion of the fluid within the concentric fluid space selectively escapes the labyrinth seal to maintain a predetermined fluid pressure within the concentric fluid space.

17. The front-load laundry appliance of claim 15, wherein the concentric fluid space includes enlarged reservoirs that are positioned at the lifter ducts.

18. The front-load laundry appliance of claim 15, wherein the concentric fluid space includes connecting channels that extend between adjacent reservoirs of the enlarged reservoirs to define the concentric fluid space as a continuous channel that extends around the drive shaft.

19. The front-load laundry appliance of claim 15, wherein the cross piece is integrally formed within the back wall of the drum, and wherein the concentric fluid space is defined by each of the drum and the tub.

20. The front-load laundry appliance of claim 15, wherein the fluid inlet extends through a structural hub that is disposed within the tub.

* * * * *